US009221242B2

(12) United States Patent
Claude et al.

(10) Patent No.: US 9,221,242 B2
(45) Date of Patent: Dec. 29, 2015

(54) INK WIPING SYSTEM FOR AN INTAGLIO PRINTING PRESS

(75) Inventors: Laurent Claude, St. Sulpice (CH); Antoine Merminod, Gimel (CH)

(73) Assignee: KBA-NotaSys SA, Lausanne (CH)

( * ) Notice: Subject to any disclaimer, the term of this patent is extended or adjusted under 35 U.S.C. 154(b) by 86 days.

(21) Appl. No.: 14/119,014

(22) PCT Filed: May 15, 2012

(86) PCT No.: PCT/IB2012/052414

§ 371 (c)(1),
(2), (4) Date: Feb. 19, 2014

(87) PCT Pub. No.: WO2012/160476

PCT Pub. Date: Nov. 29, 2012

(65) Prior Publication Data

US 2014/0196620 A1 Jul. 17, 2014

(30) Foreign Application Priority Data

May 20, 2011 (EP) ..... 11166852

(51) Int. Cl.
*B41F 9/08* (2006.01)
*B41F 9/10* (2006.01)
*B41F 31/20* (2006.01)

(52) U.S. Cl.
CPC ..... *B41F 9/08* (2013.01); *B41F 9/1018* (2013.01); *B41F 31/20* (2013.01)

(58) Field of Classification Search
CPC ..... B41F 9/08; B41F 9/10; B41F 9/1009; B41F 9/1018
See application file for complete search history.

(56) References Cited

U.S. PATENT DOCUMENTS 1,927,056 A 9/1933 Aitchison
2,987,993 A 6/1961 Giori (Continued)

FOREIGN PATENT DOCUMENTS

CH 477 293 10/1969
DE 28 48 021 3/1980

(Continued)

OTHER PUBLICATIONS

International Search Report for PCT/IB2012/052414, mailed Jul. 10, 2012.

(Continued)

*Primary Examiner* — David Banh
(74) *Attorney, Agent, or Firm* — Nixon & Vanderhye P.C.

(57) ABSTRACT

There is described an ink wiping system (100) for an intaglio printing press comprising a rotatable wiping roller assembly (102) designed to wipe excess ink from the surface of a rotatable intaglio printing cylinder (80). The rotatable wiping roller assembly (102) comprises a rotatable hollow cylindrical body (110) having an outer surface (110*a*) positioned to wipe the surface of the printing cylinder (80), and a pressing device (130) disposed inside the cylindrical body (110) and designed lo exert pressure on an inner surface (110*b*) of the cylindrical body (110) and to allow adjustment of a wiping pressure between the cylindrical body and the intaglio printing cylinder (80). The pressing device (130) preferably comprises a plurality of pressing units (132) that are distributed axially along the inside of the hollow cylindrical body (110) to allow adjustment of the wiping pressure between the cylindrical body (110) and the intaglio printing cylinder at a plurality of axial positions along the length of the hollow cylindrical body (110).

24 Claims, 17 Drawing Sheets

(56) References Cited

U.S. PATENT DOCUMENTS

| | | | | | |
|---|---|---|---|---|---|
| 3,656,431 | A * | 4/1972 | Giori | 101/425 |
| 3,762,319 | A * | 10/1973 | Gazzola et al. | 101/155 |
| 3,785,286 | A | 1/1974 | Giori | |
| 3,888,172 | A | 6/1975 | D'Amato et al. | |
| 3,900,595 | A | 8/1975 | Giori | |
| 4,054,685 | A | 10/1977 | Giori | |
| 4,224,095 | A * | 9/1980 | Giori | 156/228 |
| 4,240,347 | A | 12/1980 | Hazelton et al. | |
| 4,291,446 | A | 9/1981 | Marchioro | |
| 4,358,993 | A * | 11/1982 | Spillmann et al. | 99/483 |
| 4,516,496 | A | 5/1985 | Giori | |
| 4,605,366 | A * | 8/1986 | Lehmann et al. | 425/143 |
| 4,676,157 | A * | 6/1987 | Ichikawa et al. | 101/155 |
| 4,685,182 | A | 8/1987 | Lübke | |
| 5,062,359 | A | 11/1991 | Giori | |
| 5,062,360 | A | 11/1991 | Germann et al. | |
| 5,094,163 | A * | 3/1992 | Lehmann et al. | 101/153 |
| 5,152,220 | A * | 10/1992 | Lindner et al. | 101/155 |
| 5,197,174 | A * | 3/1993 | Lehmann | 492/7 |
| 5,240,666 | A * | 8/1993 | Schnyder et al. | 264/175 |
| 5,255,601 | A | 10/1993 | Blass et al. | |
| 5,282,417 | A | 2/1994 | Germann | |
| 5,290,223 | A * | 3/1994 | Lehmann | 492/7 |
| 5,345,864 | A * | 9/1994 | Machguth et al. | 101/216 |
| 5,372,068 | A * | 12/1994 | Lehmann et al. | 101/216 |
| 5,393,290 | A * | 2/1995 | Lehmann et al. | 492/16 |
| 5,527,422 | A * | 6/1996 | Lehmann et al. | 156/555 |
| 5,711,223 | A * | 1/1998 | Taylor | 101/389.1 |
| 5,765,480 | A * | 6/1998 | Toyoda | 101/169 |
| 5,899,145 | A | 5/1999 | Schaede | |
| 6,050,187 | A | 4/2000 | Kuhn et al. | |
| 6,111,261 | A | 8/2000 | Bolza-Schunemann et al. | |
| 6,176,482 | B1 | 1/2001 | Reinhard et al. | |
| 6,341,556 | B1 * | 1/2002 | Endo | 101/167 |
| 6,779,445 | B2 | 8/2004 | Schaede | |
| 7,011,020 | B2 | 3/2006 | Dunninger et al. | |
| 7,913,641 | B2 | 3/2011 | Dupertuis et al. | |
| 8,231,125 | B2 | 7/2012 | Hendle et al. | |
| 8,302,558 | B2 | 11/2012 | Ripamonti et al. | |
| 8,516,960 | B2 | 8/2013 | Bollettin et al. | |
| 2003/0010233 | A1 | 1/2003 | Schaede | |
| 2004/0079250 | A1 * | 4/2004 | Lorig et al. | 101/375 |
| 2004/0237816 | A1 | 12/2004 | Dunninger et al. | |
| 2005/0056169 | A1 * | 3/2005 | Hashimoto et al. | 101/119 |
| 2005/0061177 | A1 * | 3/2005 | Salvestro et al. | 101/376 |
| 2005/0127595 | A1 | 6/2005 | Hendle et al. | |
| 2006/0144265 | A1 | 7/2006 | Dunninger et al. | |
| 2007/0181016 | A1 | 8/2007 | Schaede | |
| 2008/0216683 | A1 | 9/2008 | Dupertuis et al. | |
| 2008/0245246 | A1 | 10/2008 | Dupertuis et al. | |
| 2008/0268168 | A1 | 10/2008 | Ripamonti et al. | |
| 2009/0023567 | A1 * | 1/2009 | Johner et al. | 492/52 |
| 2009/0096156 | A1 | 4/2009 | Hendle et al. | |
| 2009/0183644 | A1 | 7/2009 | Bollettin et al. | |

FOREIGN PATENT DOCUMENTS

| | | | | |
|---|---|---|---|---|
| EP | 0 091 709 | | 10/1983 | |
| EP | 0 203 279 | | 12/1986 | |
| EP | 0 406 157 | | 1/1991 | |
| EP | 0 415 881 | | 3/1991 | |
| EP | 0 439 822 | | 8/1991 | |
| EP | 0 475 890 | | 3/1992 | |
| EP | 0 526 398 | | 2/1993 | |
| EP | 0 563 007 | | 9/1993 | |
| EP | 0 873 866 | | 10/1998 | |
| EP | 0 881 072 | | 12/1998 | |
| EP | 1 602 483 | | 12/2005 | |
| EP | 1 844 930 | | 10/2007 | |
| GB | 2 065 561 | | 7/1981 | |
| IN | 118869 | | 8/1969 | |
| JP | 09193337 | A * | 7/1997 | B41F 9/08 |
| WO | WO 97/36813 | | 10/1997 | |
| WO | WO 97/37329 | | 10/1997 | |
| WO | WO 01/54904 | | 8/2001 | |
| WO | WO 03/047862 | | 6/2003 | |
| WO | WO 03/070465 | | 8/2003 | |
| WO | WO 2004/026580 | | 4/2004 | |
| WO | WO 2005/118294 | | 12/2005 | |
| WO | WO 2007/031925 | | 3/2007 | |
| WO | WO 2007/031927 | | 3/2007 | |
| WO | WO 2007/034362 | | 3/2007 | |
| WO | WO 2007/116353 | | 10/2007 | |

OTHER PUBLICATIONS

Written Opinion for PCT/IB2012/052414,. Mailed Jul. 10, 2012.

* cited by examiner

INK WIPING SYSTEM FOR AN INTAGLIO PRINTING PRESS

This application is the U.S. national phase of International Application No. PCT/IB2012/052414, filed 15 May 2012, which designated the U.S. and claims priority to EP Application No. 11166852.1, filed 20 May 2011, the entire contents of each of which are hereby incorporated by reference.

TECHNICAL FIELD

The present invention generally relates to the wiping of rotatable intaglio printing cylinders of intaglio printing presses. More precisely, the present invention relates to an ink wiping system for an intaglio printing press comprising a rotatable wiping roller assembly designed to wipe excess ink from the surface of a rotatable intaglio printing cylinder of the intaglio printing press. The present invention also relates to an inking wiping system comprising a pressing device designed to exert pressure on a first surface of a displaceable wiping medium whose second surface, opposite the first surface, is positioned to wipe excess ink from the surface of a rotatable intaglio printing cylinder of the intaglio printing press. The present invention further relates to intaglio printing presses comprising such ink wiping systems.

BACKGROUND OF THE INVENTION

Intaglio printing presses are widely used in security printing for printing security documents, especially banknotes. Prior art intaglio printing presses are for instance disclosed in Swiss Patent No. CH 477 293, European Patent Applications Nos. EP 0 091 709 A1, EP 0 406 157 A1, EP0 415 881 A2, EP 0 563 007 A1, EP 0 873 866 A1, EP 1 602 483 A1, and International Applications Nos. WO 01/54904 A1, WO 03/047862 A1, WO 2004/026580 A1, WO 2005/118294 A1.

FIGS. 1 and 2 schematically illustrate a known intaglio printing press configuration with an intaglio printing unit configuration similar to that disclosed in European Patent Application No. EP 0 091 709 A1.

FIG. 1 shows a sheet-fed intaglio printing press 1 comprising, as is usual in the art, a sheet feeder 2 for feeding sheets to be printed, an intaglio printing unit 3 for printing the sheets, and a sheet delivery unit 4 for collecting the freshly-printed sheets. The intaglio printing unit 3 typically includes an impression cylinder 7, a plate cylinder 8 carrying intaglio printing plates (in this example, the plate cylinder 8 is a three-segment cylinder carrying three intaglio printing plates 8*a*, 8*b*, 8*c*—FIG. 2), an inking system 9 for inking the surface of the intaglio printing plates 8*a*, 8*b*, 8*c* carried by the plate cylinder 8 and an ink wiping system 10 for wiping the inked surface of the intaglio printing plates 8*a*, 8*b*, 8*c* carried by the plate cylinder 8 prior to printing of the sheets.

The sheets are fed from the sheet feeder 2 onto a feeder table and then onto the impression cylinder 7. The sheets are then carried by the impression cylinder 7 to the printing nip formed by the contact location between the impression cylinder 7 and the plate cylinder 8 where intaglio printing is performed. Once printed, the sheets are transferred from the impression cylinder 7 to a sheet transporting system 11 in order to be delivered to the delivery unit 4. The sheet transporting system 11 conventionally comprises an endless conveying system with a pair of endless chains driving a plurality of spaced-apart gripper bars for holding a leading edge of the sheets (the freshly-printed side of the sheets being oriented downwards on their way to the delivery unit 4), sheets being transferred in succession from the impression cylinder 7 to a corresponding one of the gripper bars.

During their transport to the sheet delivery unit 4, the freshly printed sheets are preferably inspected by an optical inspection system 5. In the illustrated example, the optical inspection system 5 is advantageously disposed along the path of the sheet transporting system 11, right after the printing unit 3. Such an optical inspection system 5 is already known in the art and does not need to be described in detail. Examples of optical inspection systems adapted for use as optical inspection system 5 in the intaglio printing press of FIG. 1 are for instance described in International Applications Nos. WO 97/36813 A1, WO 97/37329 A1 and WO 03/070465 A1. Such inspection systems are in particular marketed by the Applicant under the product designation NotaSave®.

Before delivery, the printed sheets are preferably transported in front of a drying unit 6 disposed after the inspection system 5 along the transport path of the sheet transporting system 11. Drying could possibly be performed prior to the optical inspection of the sheets.

FIG. 2 is a schematic view of the intaglio printing unit 3 of the intaglio printing press 1 of FIG. 1. As already mentioned, the intaglio printing unit 3 basically includes the impression cylinder 7, the plate cylinder 8 with its intaglio printing plates 8*a*, 8*b*, 8*c*, the inking system 9 and the ink wiping system 10.

The inking system 9 comprises in this example four inking devices, three of which cooperate with a common ink-collecting cylinder or Orlof cylinder 9.5 (here a two-segment cylinder) that contacts the plate cylinder 8. The fourth inking device is disposed so as to directly contact the surface of the plate cylinder 8. It will be understood that the illustrated inking system 9 is accordingly adapted for both indirect and direct inking of the plate cylinder 8. The inking devices cooperating with the ink-collecting cylinder 9.5 each include an ink duct 9.10, 9.20, 9.30 cooperating in this example with a pair of inking rollers 9.11, 9.21 and 9.31, respectively. Each pair of inking rollers 9.11, 9.21, 9.31 in turn inks a corresponding chablon cylinder (also designated as selective inking cylinder) 9.13, 9,23, 9.33, respectively, which is in contact with the ink-collecting cylinder 9.5. As for the fourth inking device, it includes an ink duct 9.40, an additional inking roller 9.44, a pair of inking rollers 9.41 and a chablon cylinder 9.43, this latter cylinder being in contact with the plate cylinder 8. The additional ink roller 9.44 is necessary in this latter case as the fourth inking device 9.4 is used to directly ink the surface of the plate cylinder 8 which rotates in opposite direction as compared to the ink-collecting cylinder 9.5. As is usual in the art, the surface of the chablon cylinders 9.13, 9.23, 9.33 and 9.43 is structured so as to exhibit raised portions corresponding to the areas of the intaglio printing plates 8*a*, 8*b*, 8*c* intended to receive the inks in the corresponding colours supplied by the respective inking devices.

The ink wiping system 10, on the other hand, typically comprises a wiping tank 10.1 (which is movable towards and away from the plate cylinder 8), a wiping roller 10.2 supported on and partly located in the wiping tank and contacting the plate cylinder 8, cleaning means 10.3 for removing wiped ink residues from the surface of the wiping roller 10.2 using a wiping solution that is sprayed or otherwise applied onto the surface of the wiping roller 10.2, and a drying blade 10.4 contacting the surface of the wiping roller 10.2 for removing wiping solution residues from the surface of the wiping roller 10.2. The wiping roller 10.2 can typically be removed from the wiping tank 10.1 during maintenance operations using a crane 12 (see FIG. 1).

A particularly suitable solution for an ink wiping system comprising a wiping roller is disclosed in International Application No. WO 2007/116353 A1 (corresponding to EP 1 844 930 A1) which is incorporated herein by reference in its entirety.

The most common solution used for wiping excess ink from the surface of an intaglio printing cylinder is, as discussed hereinabove, to use a wiping roller assembly that rotates in the same direction as the intaglio printing cylinder. Such wiping roller assembly typically consists of a cylinder base made commonly of metal and bearing at least one layer of wiping material, preferably a layer of polymer material such as PVC material. The structure and manufacture of such wiping rollers is for instance disclosed in U.S. Pat. Nos 3,785,286, 3,900,595,4,054,685 and International Applications Nos. WO 2007/031925 A2, WO 2007/031927 A2, WO 2007/034362 A2 which are incorporated herein by reference.

As mentioned above, such wiping roller is supported on and partly located in a wiping tank for rotation against the surface of the intaglio printing cylinder, the surface of the wiping roller being cleaned from wiped ink residues using a wiping solution that is typically sprayed onto the surface of the wiping roller.

With such a known solution, the wiping pressure between the intaglio printing cylinder and the wiping roller is adjusted by playing with the position of the axis of rotation of the wiping roller with respect to the axis of rotation of the intaglio printing cylinder. This is typically achieved by using two adjusting rods or hydraulic cylinders acting on the two ends of the wiping roller, for instance through eccentric bearings. Adjustment mechanisms for adjusting the wiping pressure between a wiping roller and an intaglio printing cylinder are for instance disclosed in European Patent Applications Nos. EP 0 475 890 A1, EP 0 526 398 A1, and U.S. Pat. Nos. 2,987,993, 3,762,319.

These adjustment mechanisms are however not entirely satisfactory as the ability to adjust the wiping pressure along the contact portion between the wiping roller and the intaglio printing cylinder is limited by the fact that one can only play with the position of the axis of rotation of the wiping roller with respect to the intaglio printing cylinder. It is therefore difficult to ensure that the wiping pressure is adequate or substantially uniform over the whole length of the contact portion between the wiping roller and the intaglio printing cylinder. This furthermore leads to a non-uniform wear of the surface of the wiping roller. An improved solution is thus required.

Furthermore, maintenance operations of the known ink wiping systems are time-consuming as the wiping roller is a relatively heavy component to manipulate, which typically necessitates the use of a crane to remove the wiping roller from the wiping tank (as for instance illustrated in FIGS. 1 and 2).

Besides the above ink wiping systems that make use of a wiping roller as wiping medium, it is also known to wipe excess ink from the surface of a rotatable intaglio printing plate by means of scraper blade mechanisms and/or wiping webs, such as paper webs. An ink wiping system for an intaglio printing press using a combination of a scraper blade mechanism and of wiping webs is for instance disclosed in U.S. Pat. No. 4,240,347 (which corresponds to GB 2 065 561). An ink wiping system for an intaglio printing press using only wiping webs is disclosed in U.S. Pat. Nos. 1,927,056 and 3,888,172.

According to the solutions described in U.S. Pat. Nos. 1,927,056, 3,888,172 and 4,240,347, the wiping web which acts as wiping medium is pressed against the surface of the intaglio printing cylinder by means of a pressing pad or shoe that extends parallel to the axis of rotation of the intaglio printing cylinder. As described more particularly in U.S. Pat. No. 4,240,347, the wiping pressure between the wiping web and the intaglio printing cylinder is adjusted by acting on the two ends of the pressing pad or shoe. Such solutions thus exhibit basically the same problems as the known ink wiping systems which make use of wiping rollers, namely a lack of ability to properly control and adjust the wiping pressure between the wiping medium and the intaglio printing cylinder over the whole length of the contact portion between the wiping medium and the intaglio printing cylinder.

SUMMARY OF THE INVENTION

A general aim of the invention is therefore to provide an improved ink wiping system for an intaglio printing press.

A further aim of the invention is to provide such an ink wiping system which offers a greater ability to control and adjust the wiping pressure over the whole length of the contact portion between the wiping medium and the intaglio printing cylinder.

Still another aim of the invention is to provide such an ink wiping system which facilitates maintenance operations.

Yet another aim of the invention is to provide an improved pressing device for exerting pressure on an inner surface of a displaceable wiping medium whose outer surface is positioned to wipe excess ink from the surface of a rotatable intaglio printing cylinder of an intaglio printing press.

These aims are achieved thanks to the ink wiping systems defined in the claims.

According to a first aspect of the invention, there is accordingly provided an ink wiping system for an intaglio printing press comprising a rotatable wiping roller assembly designed to wipe excess ink from the surface of a rotatable intaglio printing cylinder of the intaglio printing press, the rotatable wiping roller assembly comprising:

- a rotatable hollow cylindrical body having an outer surface positioned to wipe the surface of the intaglio printing cylinder; and
- a pressing device disposed inside the hollow cylindrical body and designed to exert pressure on an inner surface of the hollow cylindrical body and to allow adjustment of a wiping pressure between the hollow cylindrical body and the intaglio printing cylinder.

In an advantageous embodiment, the wiping pressure between the hollow cylindrical body and the intaglio printing cylinder is adjustable by the pressing device at a plurality of axial positions along the length of the hollow cylindrical body. Optimal pressure control all along the contact portion between the intaglio printing cylinder and the outer surface of the hollow cylindrical body is thus ensured.

According to a second aspect of the invention, there is further provided an ink wiping system for an intaglio printing press comprising a pressing device designed to exert pressure on a first surface of a displaceable wiping medium whose second surface, opposite the first surface, is positioned to wipe excess ink from the surface of a rotatable intaglio printing cylinder of the intaglio printing press, the pressing device extending transversely to a direction of displacement of the wiping medium and being further designed to allow adjustment of a wiping pressure between the wiping medium and the intaglio printing cylinder at a plurality of transverse positions transversely to the direction of displacement of the wiping medium.

In an advantageous embodiment, the pressing device comprises a plurality of pressing units that are distributed transversely to the direction of displacement of the wiping medium to allow adjustment of the wiping pressure between the wiping medium and the intaglio printing cylinder at the plurality of transverse positions transversely to the direction of displacement of the wiping medium.

There is also provided an intaglio printing press comprising such ink wiping systems.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Within the context of the present invention, the expression "intaglio printing cylinder" designates either a cylinder whose surface is provided with intaglio patterns engraved directly onto the circumference of the cylinder or of a cylinder sleeve, or a plate cylinder carrying on its circumference at least one intaglio printing plate with engraved intaglio patterns (the second solution being now more common in the art). In the following description, the intaglio printing cylinder is a plate cylinder carrying several intaglio printing plates on its circumference.

Further, within the context of the present invention, the expression "wiping medium" designates a medium having a surface (hereinafter the "second surface" or "outer surface") positioned to wipe excess ink from the surface of a rotatable intaglio printing cylinder of an intaglio printing press and a surface (hereinafter the "first surface" or "inner surface") onto which a pressing device acts to urge the opposite second surface of the wiping medium against the surface of the intaglio printing cylinder that is to be wiped from excess ink. In a preferred embodiment of the present invention, the wiping medium takes the shape of a hollow cylindrical body, the first and second surfaces of the wiping medium being respectively an inner surface and an outer surface of the hollow cylindrical body. The wiping medium can alternatively take the shape of a wiping web that is unwound from a supply roll and wound around a waste roll.

Figure 1:
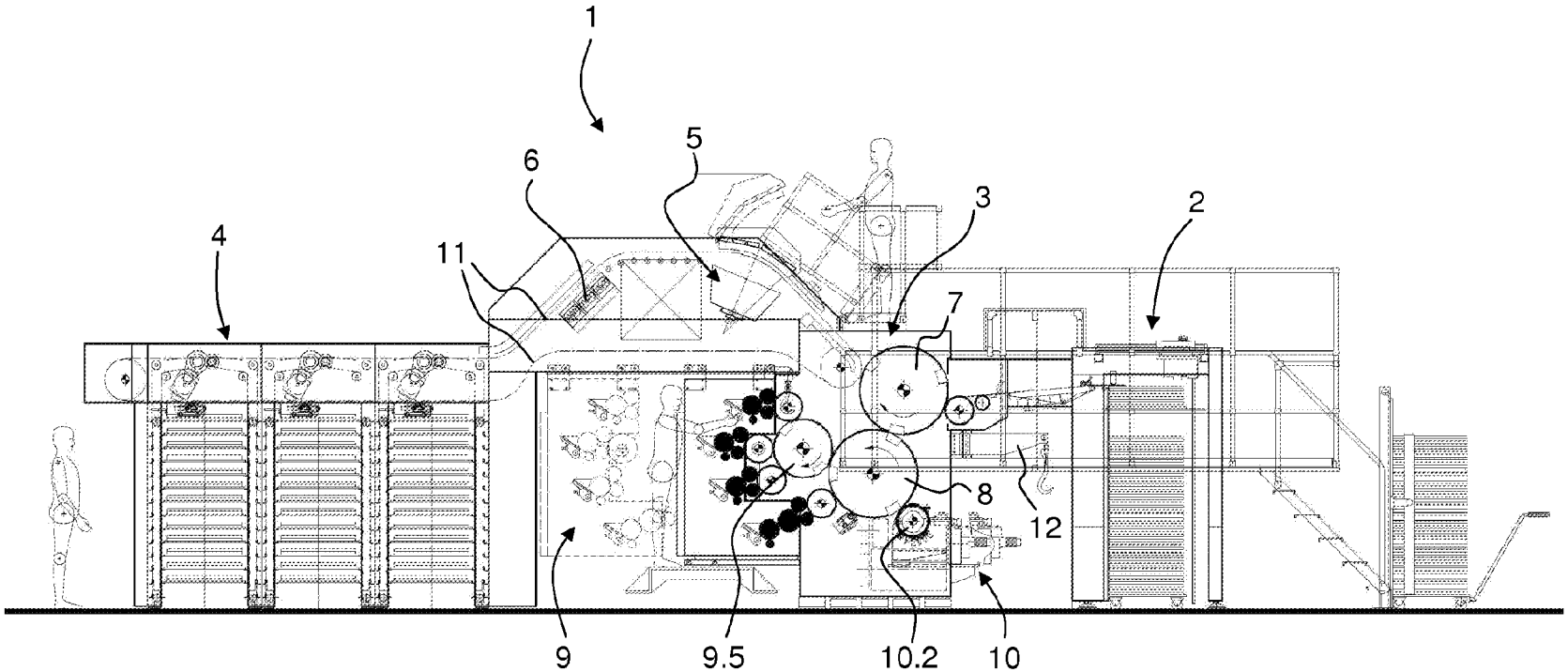
Fig. 1 (PRIOR ART)
FIG. 1 is a side-view of a known intaglio printing press.
Figure 2:
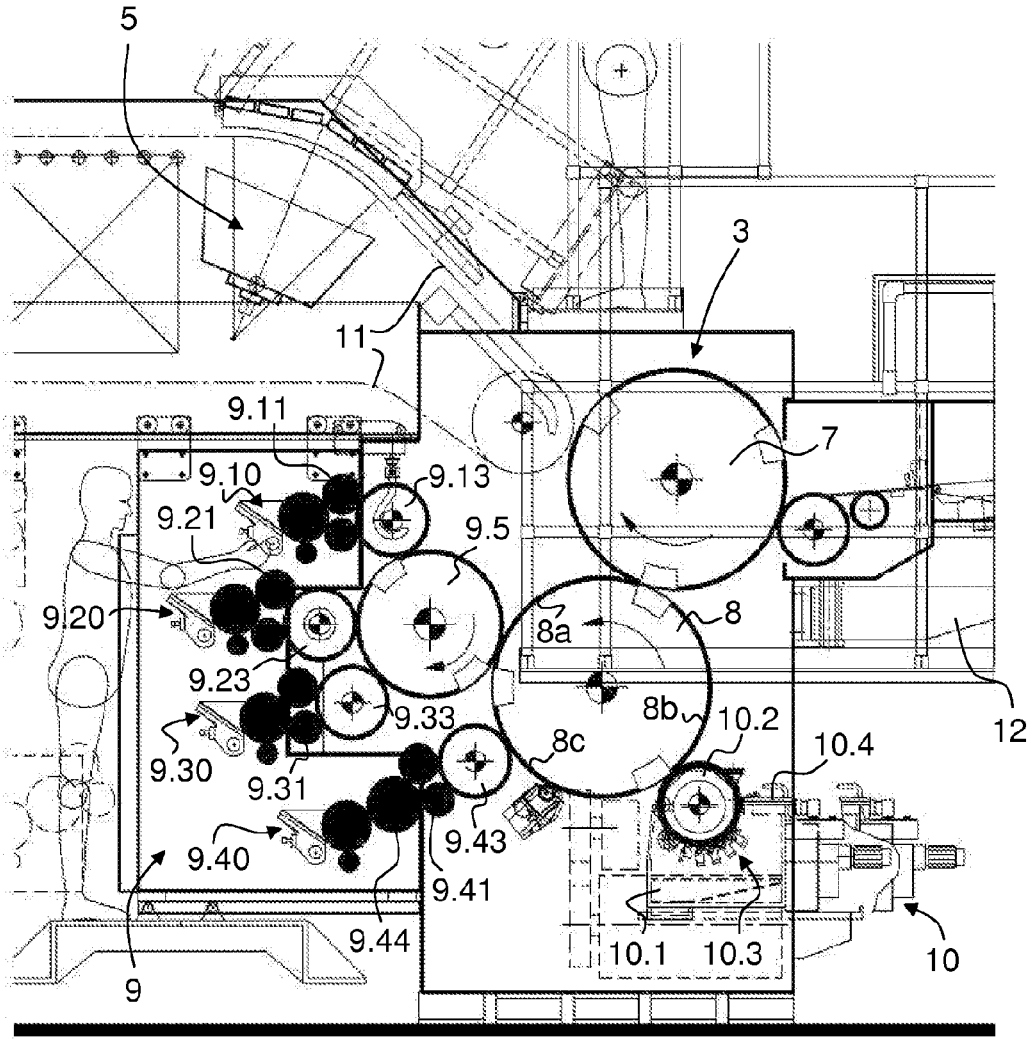
Fig. 2 (PRIOR ART)
FIG. 2 is an enlarged side view of the intaglio printing unit of the intaglio printing press of FIG. 1.
Figure 3:
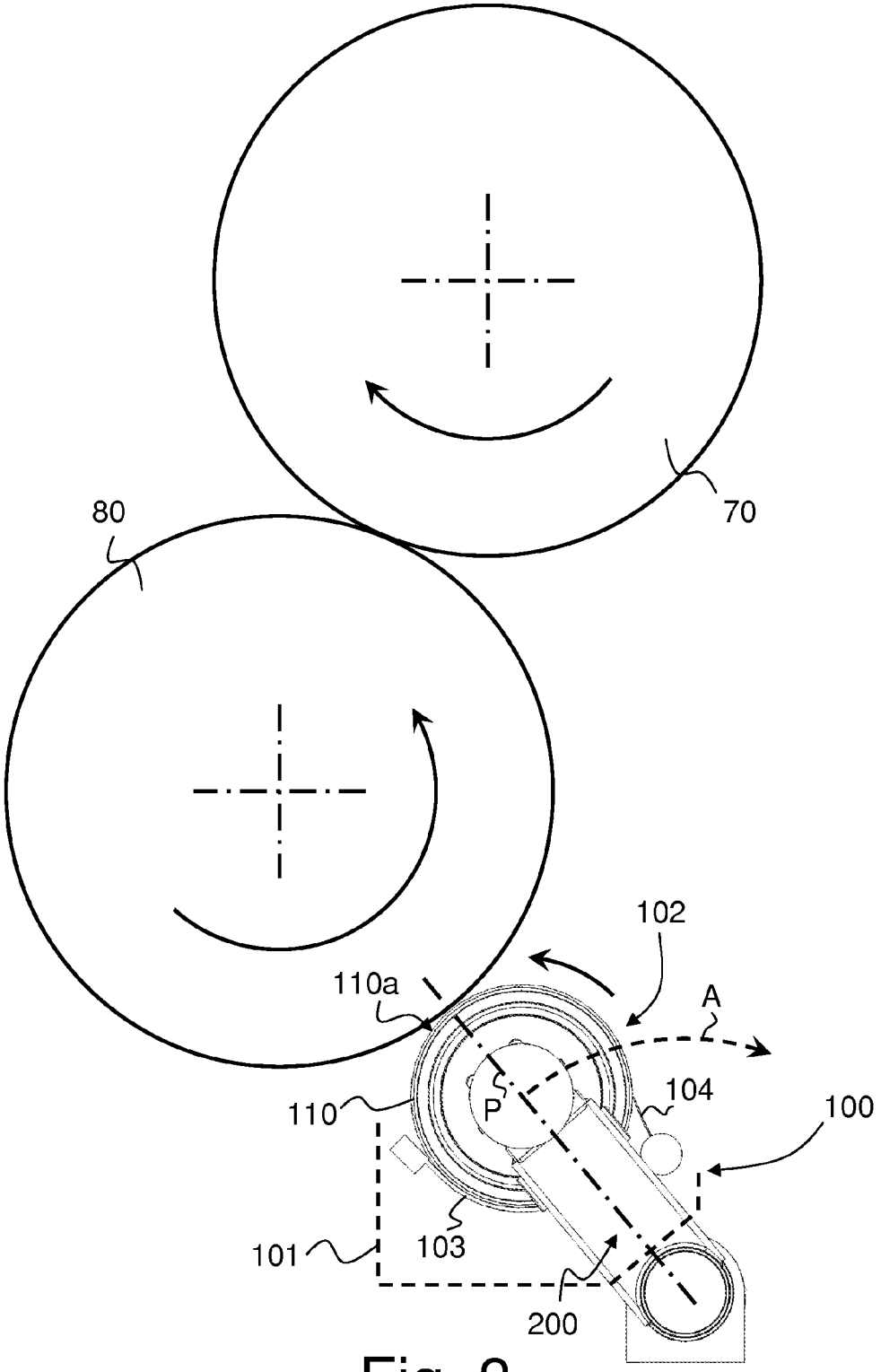
FIG. 3 is a schematic side view of an ink wiping system in accordance with a preferred embodiment of the invention, the wiping system being illustrated in a working position contacting an intaglio printing cylinder of an intaglio printing press.

FIG. 3 shows a schematic representation of an ink wiping system 100 for an intaglio printing unit in accordance with the invention. As is known in the art, an impression cylinder 70 and an intaglio printing cylinder 80 cooperate in rotation. In the present embodiment, it is to be understood that the intaglio printing cylinder 80 is designed as a plate cylinder carrying a plurality of intaglio printing plates (as in the example of FIGS. 1 and 2).

Figure 4:
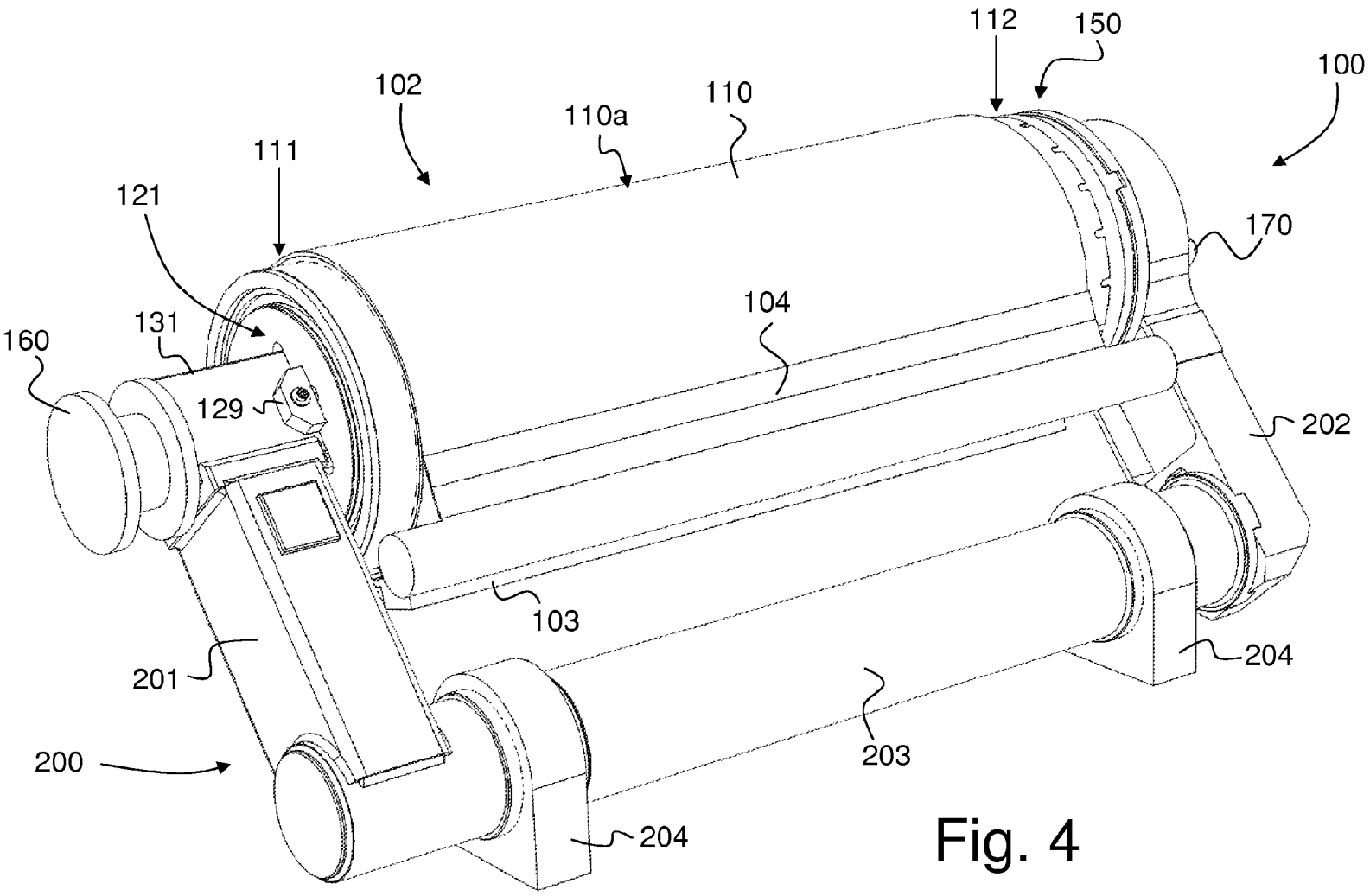
FIGS. 4 to 8 are perspective views of the ink wiping system of FIG. 3.
Figure 5:
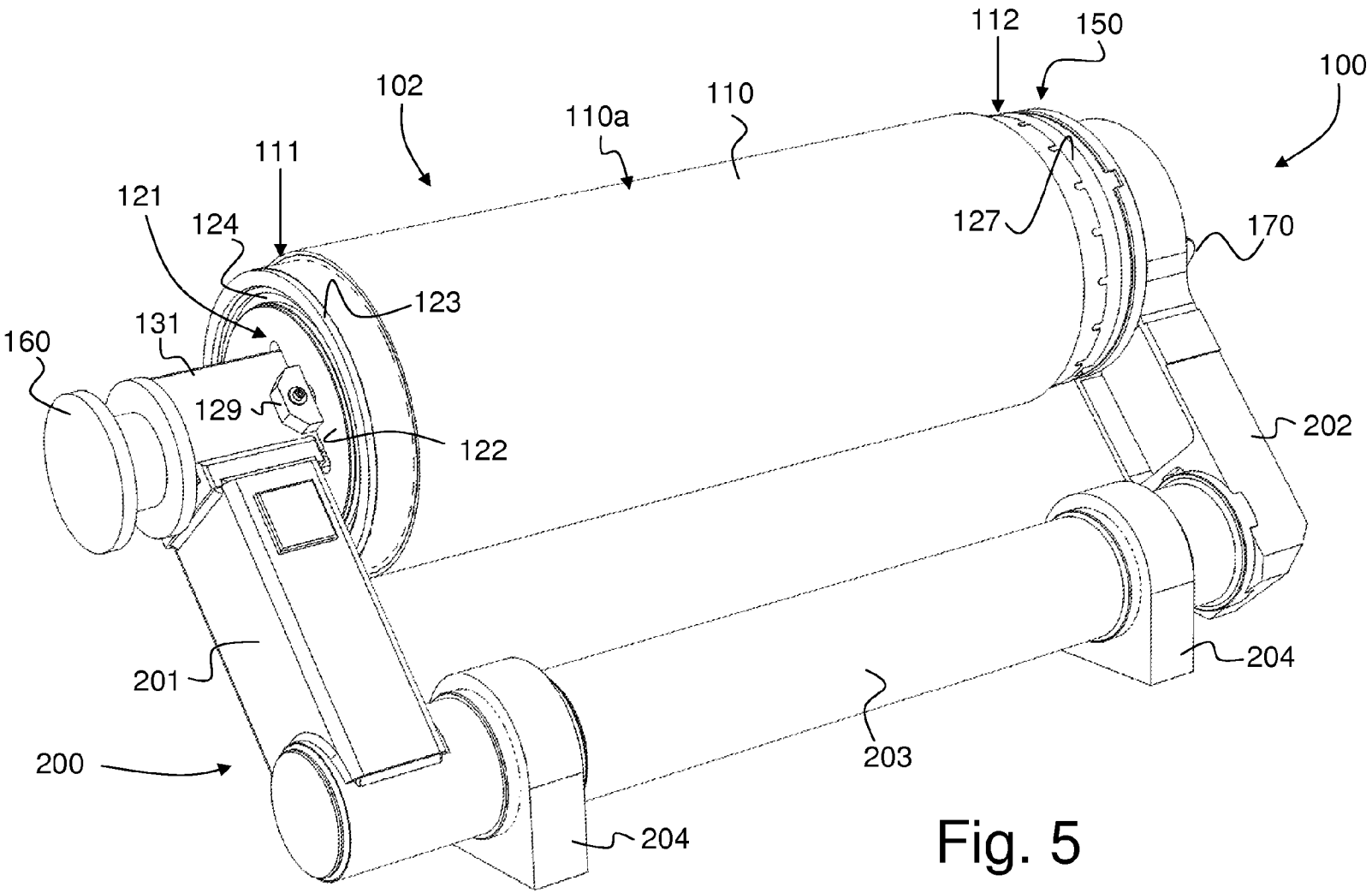
Figure 6:
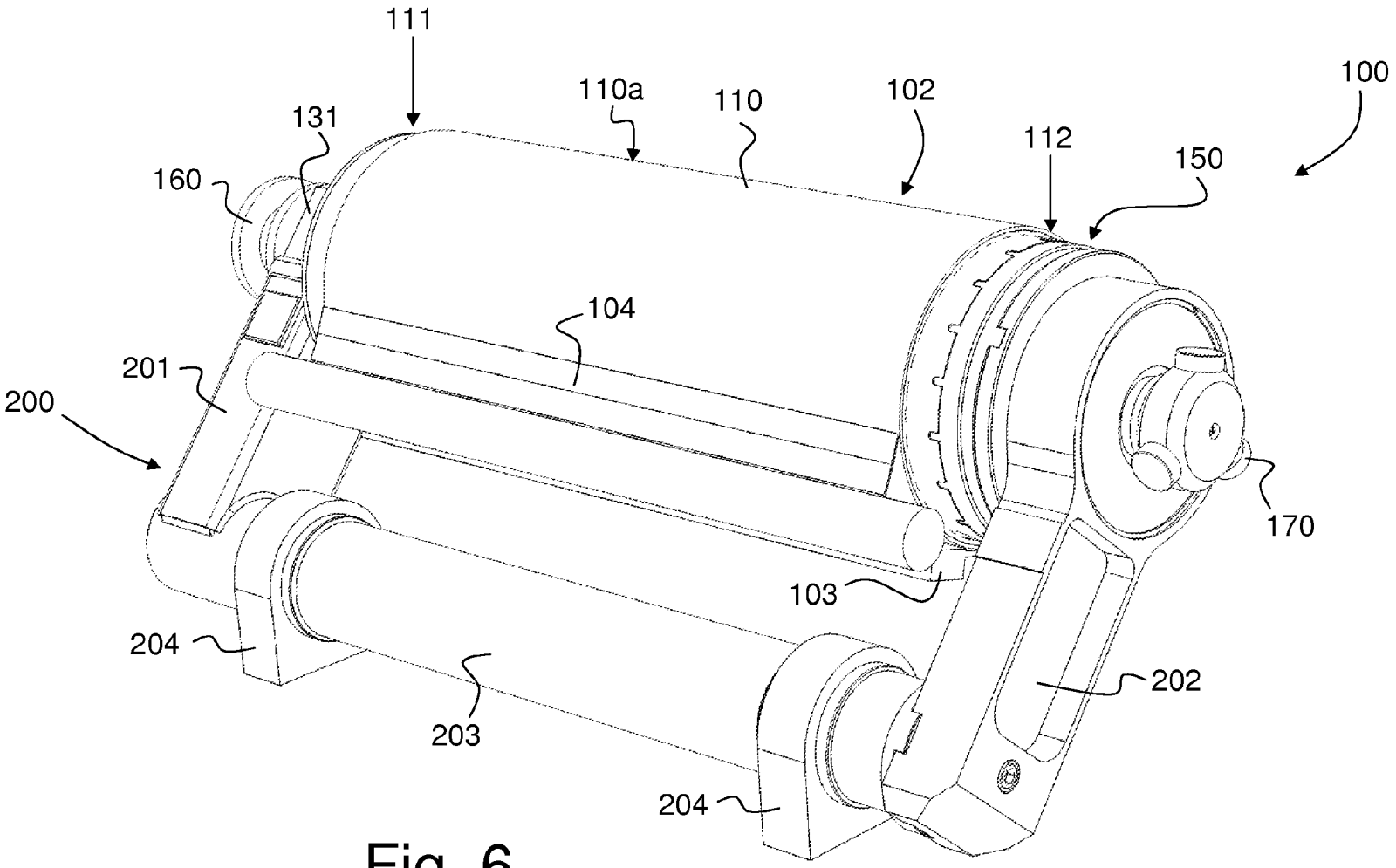
Figure 7:
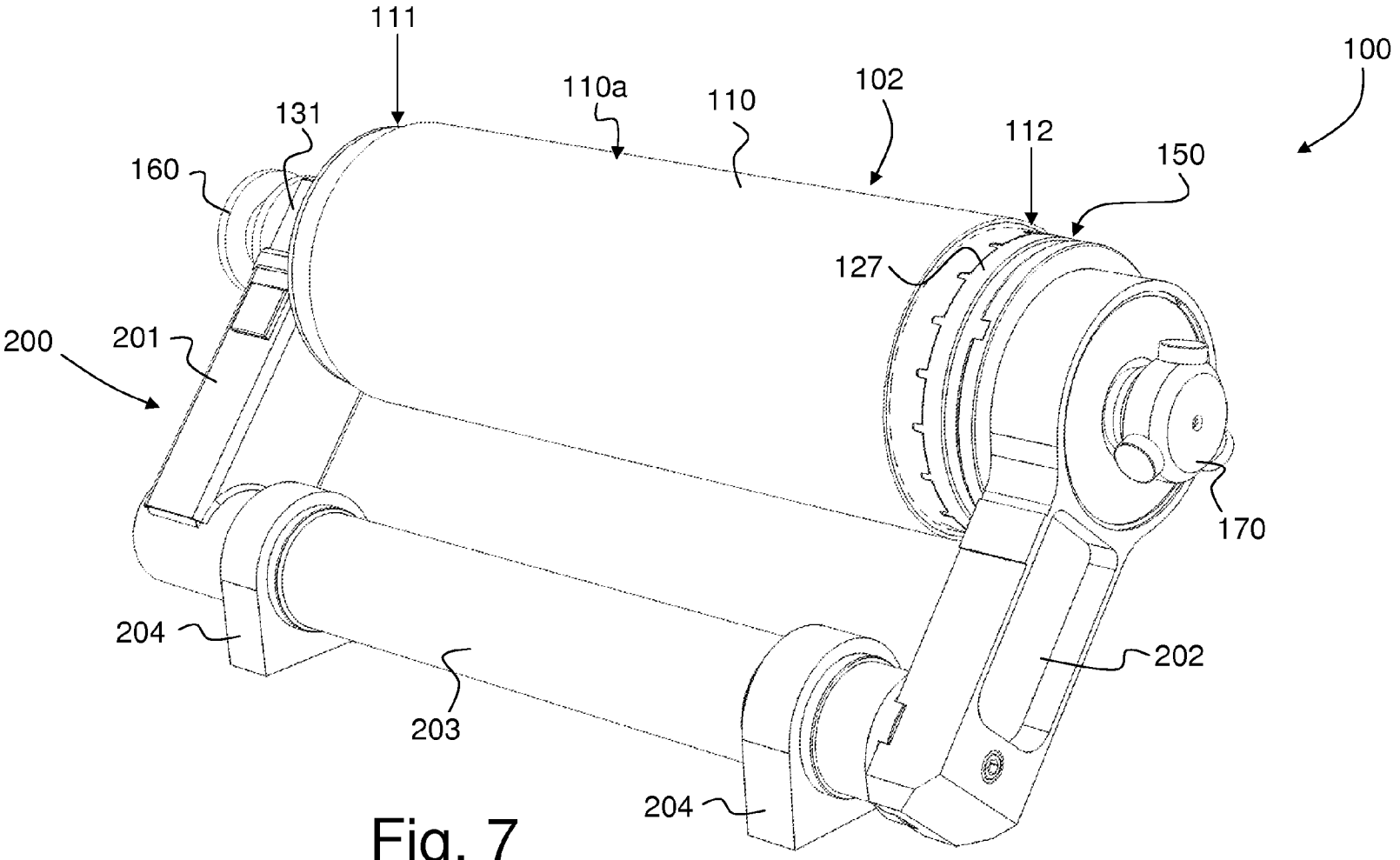
Figure 8:
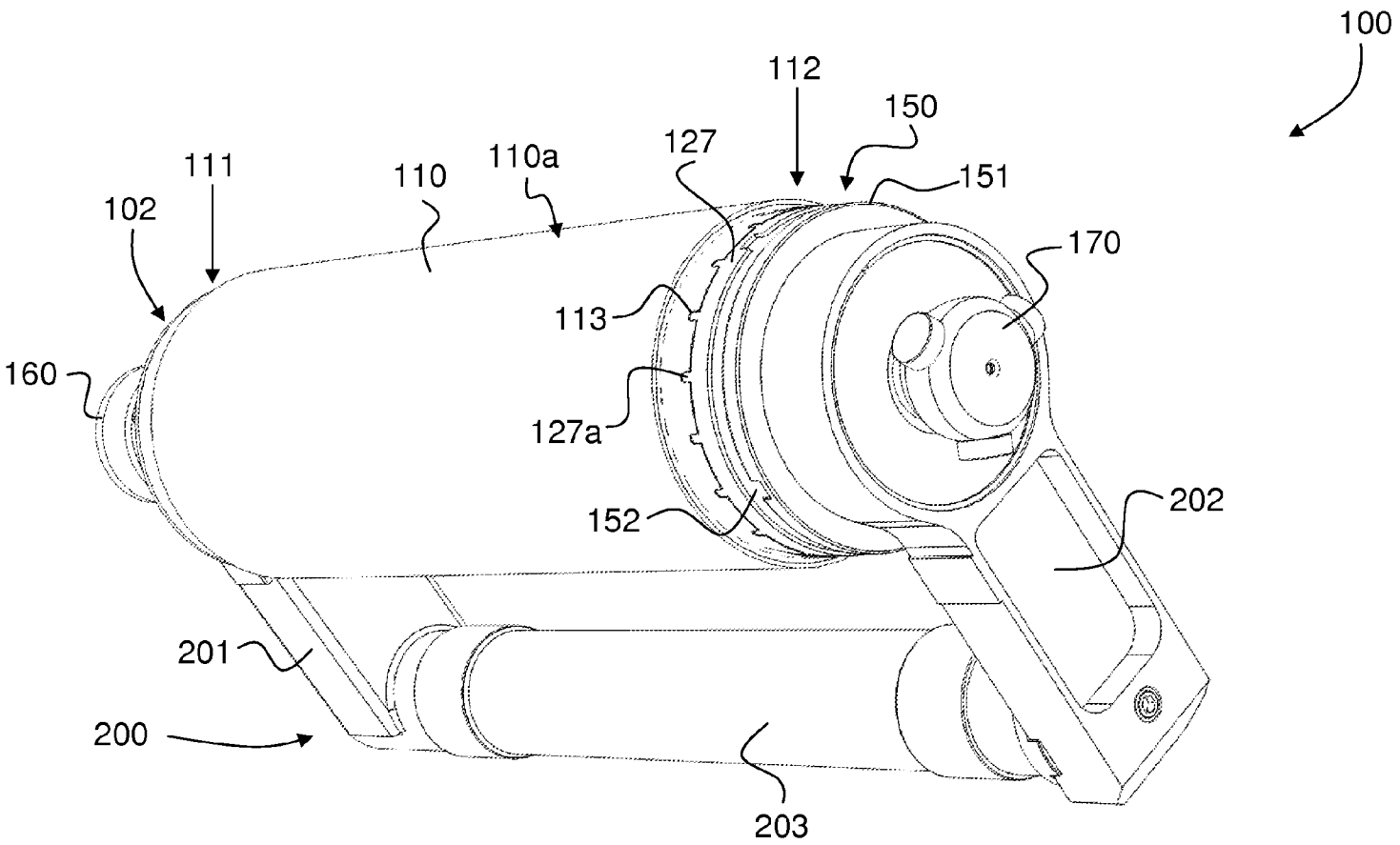
Figure 10:
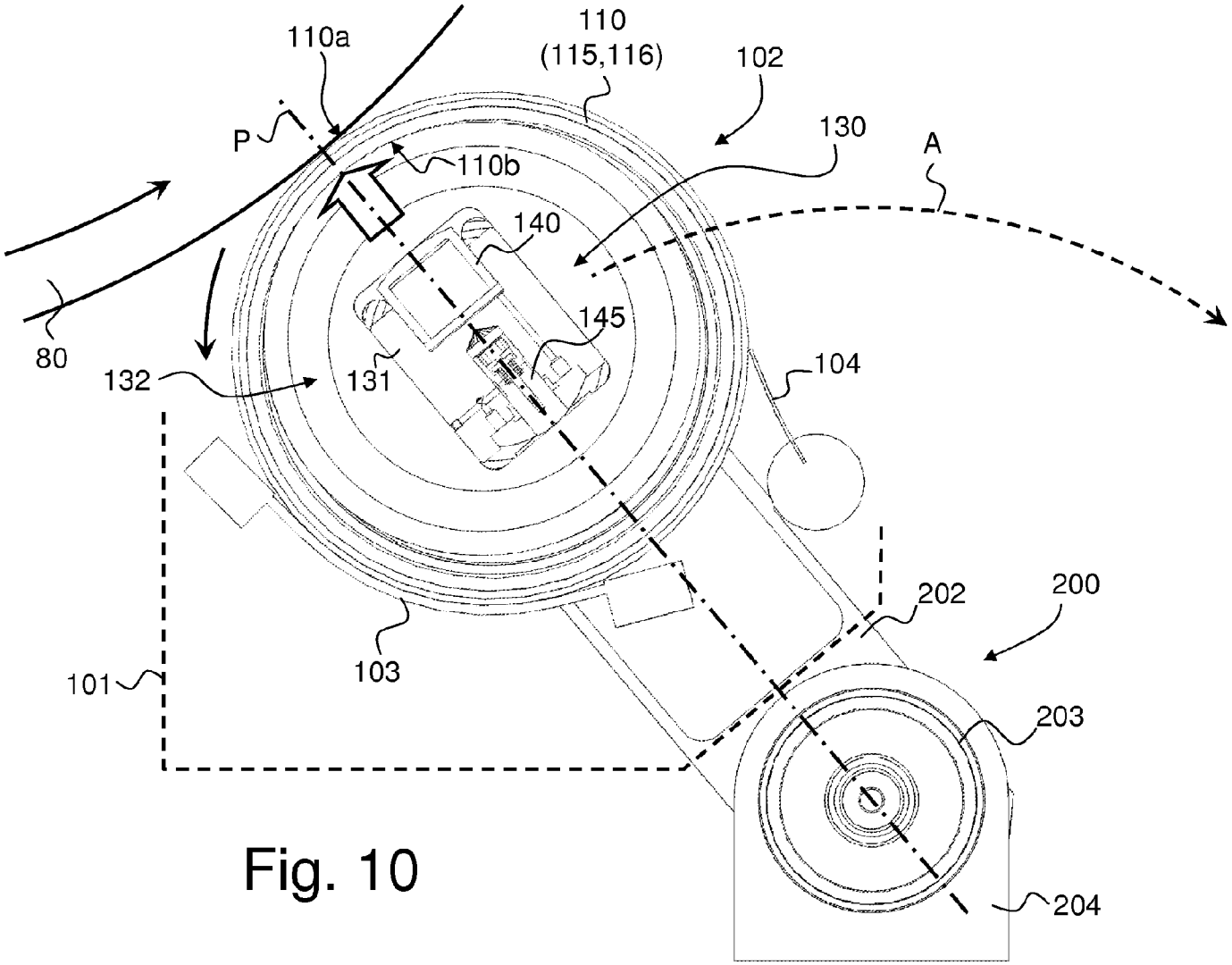
FIG. 10 is a schematic sectional view of the rotatable hollow cylindrical body of FIG. 9 (taken perpendicularly to the axis of rotation of the hollow cylindrical body) in the working position contacting the intaglio printing cylinder of the intaglio printing press.

According to this embodiment of the invention, a wiping roller assembly 102 is rotatably mounted on and partly located in a wiping tank 101 and comprises a rotatable hollow cylindrical body 110 whose outer surface 110*a* is positioned to wipe the surface of the intaglio printing cylinder 80. The wiping tank 101 is placed underneath the wiping roller assembly 102 for recuperating the wiping solution that has previously been sprayed by at least one spraying unit (not shown) against the surface of the wiping roller assembly 102. In order to efficiently remove the ink residues and the sprayed wiping solution present on the outer surface 110*a* of the hollow cylindrical body 110, the ink wiping system 100 further comprises cleaning means 103 for removing ink residues from the surface of the wiping roller assembly 102. Such cleaning means are known in the art, for instance from International Application No. WO 2007/116353 A1. Downstream with respect to the direction of rotation of the wiping roller assembly 102, a scraping blade 104, also known as a "drying blade", is arranged to contact the surface of the wiping roller assembly 102 and remove residual wiping solution and any potential ink residues still present on the outer surface 110*a*. Elements 103 and 104 are also shown in perspective view in FIGS. 4 and 6. FIG. 10 also shows a side view of the ink wiping system with the cleaning means 103 extending circumferentially along a portion of the circumference of the wiping roller assembly 102 and the drying blade 104 located downstream of the cleaning means 103.

FIGS. 4 to 8 are various perspective views of the ink wiping system 100 showing the wiping roller assembly 102 with its hollow cylindrical body 110 mounted a corresponding supporting mechanism 200, also visible on FIG. 3.

The rotatable hollow cylindrical body 110 has a first end 111, a second end 112 and an outer surface 110*a*. The second end 112 is also referred to as the driving end as explained below. An elongated central beam 131 is provided in the central hollow portion of the cylindrical body 110 and extends on both sides beyond the first and second ends 111 and 112 (see also FIG. 9). The hollow cylindrical body 110 is rotatably mounted on the central beam 131 with a bearing arrangement comprising a first cylinder bearing 121 provided at the first end 111, and a second cylinder bearing 125 (visible in FIG. 9) provided at the second end 112.

Figure 9:
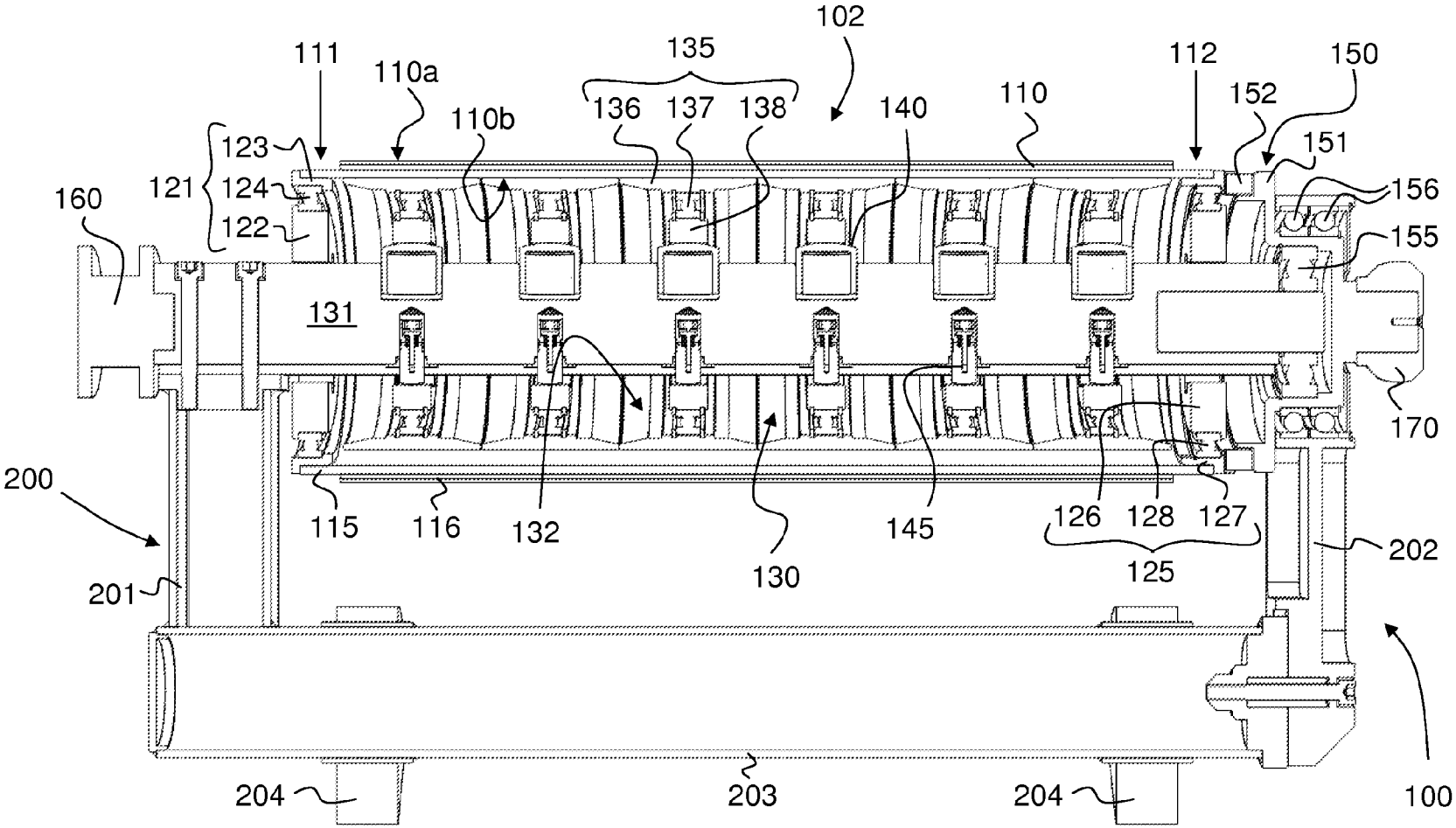
FIG. 9 is a perspective sectional view of the rotatable hollow cylindrical body (taken along an axis of rotation of the hollow cylindrical body) of the ink wiping system mounted on a supporting mechanism.
Figure 17:
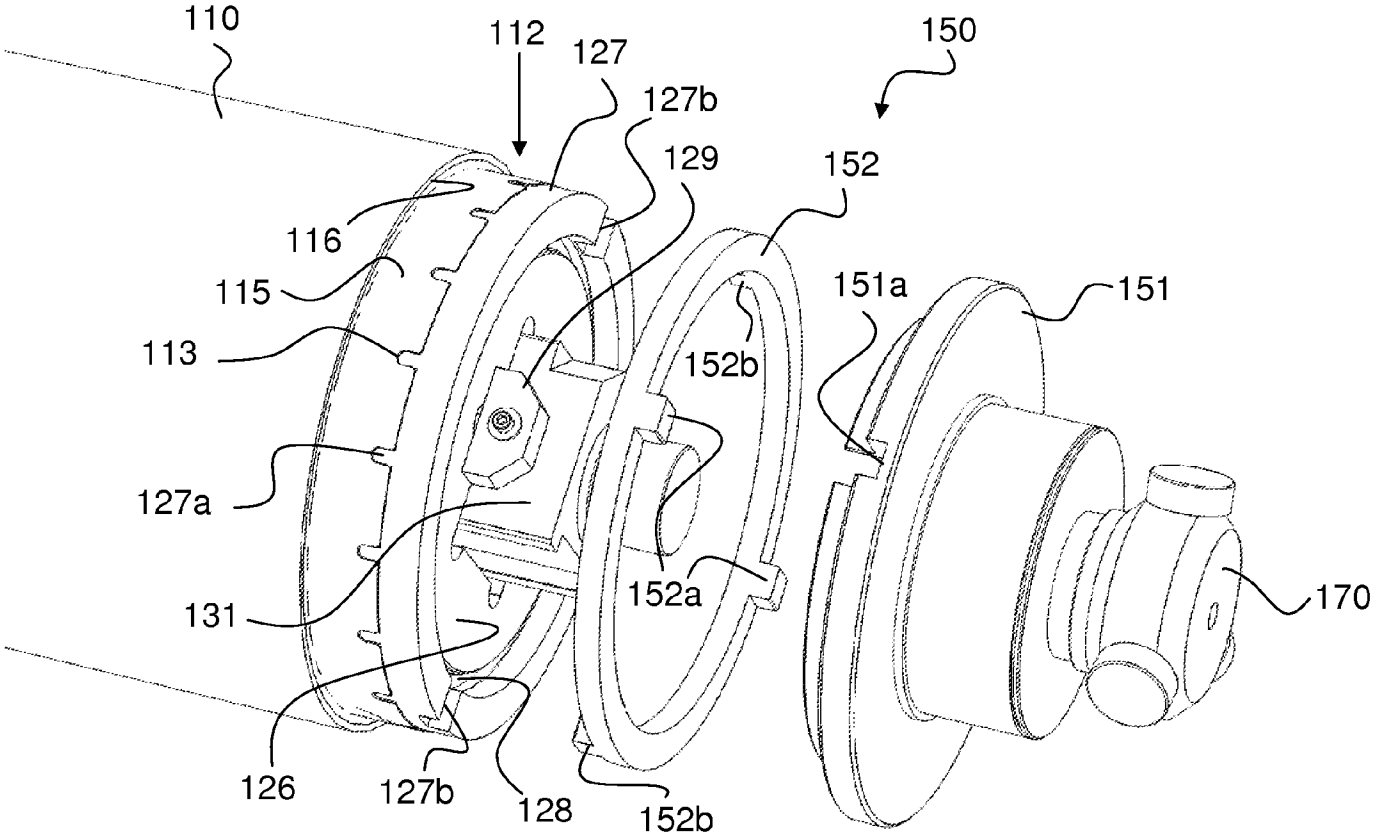
FIG. 17 is an enlarged exploded view of the driving end of the hollow cylindrical body with an example of a coupler arrangement disassembled.

FIG. 9 shows further details of the first and second cylinder bearings 121,125. At the first end 111 of the hollow cylinder 110, the outer portion of the cylinder bearing 121 is provided with a rotatable supporting ring 123 which cooperates with the inner surface 110*b* of the hollow cylindrical body 110. A flange 122 is coupled to the central beam 131 and a roller bearing 124 is interposed between the flange 122 and the rotatable supporting ring 123 to allow for rotation of the rotatable hollow cylinder 110 about the central beam 131. At the second end 112, acting as a driving end, a similar configuration is provided for the second cylinder bearing 125. Namely, a rotatable supporting ring 127 is coupled to the inner surface 110*b* of the hollow cylindrical body 110, and a flange 126 cooperates with the central beam 131, a roller bearing 128 being interposed between the flange 126 and the rotatable supporting ring 127 to allow for rotation of the rotatable hollow cylinder 110 about the central beam 131. In this particular example, the rotatable support ring 127 is also designed as an output coupler of a so-called Oldham coupler arrangement 150, as further described in relation to FIG. 17.

The central beam 131 is supported by a supporting mechanism 200 provided with two arms, a first arm 201 cooperating with the extremity of the central beam 131 proximate to the first end 111 of the cylindrical body 110 and a second arm 202 which is coupled rotatably to the second end 112 of the hollow cylindrical body 110. An elongated support beam 203 extending longitudinally, substantially parallel to the cylindrical body 110, supports both arms 201 and 202. In the illustrated example, two supporting feet 204 are provided on each side of the support beam 203 in order to anchor the supporting mechanism 200 to a suitable portion of the intaglio printing press and enable rotational support of the support beam 203 and associated supporting arms 201 and 202.

FIG. 10 shows a sectional view of the supporting mechanism 200 where A schematically illustrates a pivotal movement allowing the wiping roller assembly 102 to be brought from the illustrated working position to a maintenance position.

Turning back to FIGS. 4 and 5, lateral stops 129 (see also FIG. 14) are provided on the central beam 131, on each side of the hollow cylindrical body 110, to secure the corresponding flanges 122, 126 of the first and second cylinder bearings 121,125 on the central beam 131.

The ink wiping system 100 is further provided with a device 160, mounted on an axial extension of the central beam 131, next to the first end 111 of the hollow cylindrical body 110, to ensure an axial reciprocation of the wiping roller assembly 102 along its axis of rotation. Such device 160 can in particular be designed to act as a cam follower cooperating with a cam mechanism (not shown), as is known in the art. Reciprocation of the wiping roller assembly 102 along its axis of rotation is advantageous in that in ensures better wiping uniformity.

A tripod drive head 170, better shown in FIGS. 6 to 9, 13,14 and 17, for coupling to a wiping roller drive (not shown), is provided to drive the wiping roller assembly 102 into rotation. Further details concerning the tripod drive head 170 will be given in relation to FIG. 14. A suitable drive for driving the wiping roller assembly 102 into rotation is known from European Patent Application No. EP 0 881 072 A1.

In this particular example, driving of the hollow cylindrical body 110 into rotation is ensured by way of an Oldham coupler arrangement 150 which is coupled to the driving end 112 of the hollow cylindrical body 110. More precisely, as illustrated in FIGS. 8, 9, 13, 14 and 17, the Oldham coupler arrangement 150 comprises an input coupler 151 rotating together with the tripod drive head 170, which coupling arrangement will be discussed in greater detail in relation to FIG. 17.

Turning now to FIGS. 9 to 12, one will describe further details of the components provided inside the hollow portion of the rotatable hollow cylindrical body 110. As illustrated, the rotatable hollow cylindrical body 110 is provided with a pressing device 130 disposed inside the hollow cylindrical body 110 designed to exert pressure on the inner surface 110*b* of the hollow cylindrical body 110 and to allow adjustment of the wiping pressure between the hollow cylindrical body 110 and the intaglio printing cylinder 80. In this particular example, the pressing device 130 is disposed on the central beam 131.

According to this preferred embodiment, the wiping pressure can be adjusted by the pressing device at a plurality of axial positions along the length of the hollow cylindrical body. In this particular example, the pressing device 130 advantageously comprises six pressing units 132 that are distributed axially along the inside of the hollow cylindrical body 110 and allow adjustment of the wiping pressure between the hollow cylindrical body 110 and the intaglio printing cylinder 80 at six corresponding axial positions along the length of the hollow cylindrical body 110.

Each pressing unit 132 preferably comprises a position-adjustable pressing member 135 designed to exert pressure on the inner surface 110*b* of the hollow cylindrical body 110 and an actuator 140, such as a pneumatic piston, designed to allow adjustment of a radial position of the pressing member 135 inside the hollow cylindrical body 110. As shown, the actuators 140 are provided in this example on the central beam 131.

Figure 11:
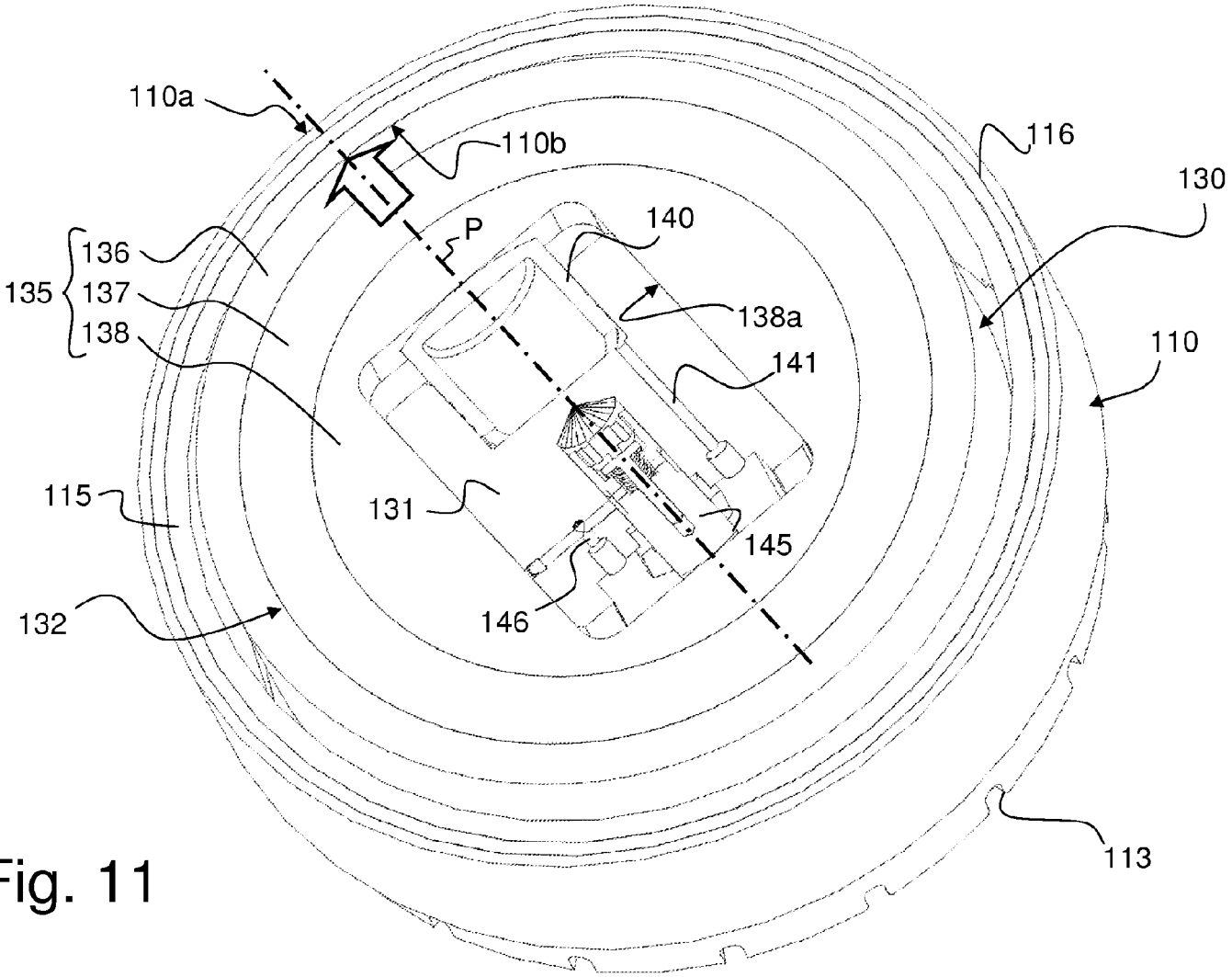
FIG. 11 is a perspective sectional view of an inner portion of the hollow cylindrical body (taken perpendicularly to the axis of rotation of the hollow cylindrical body)
Figure 12:
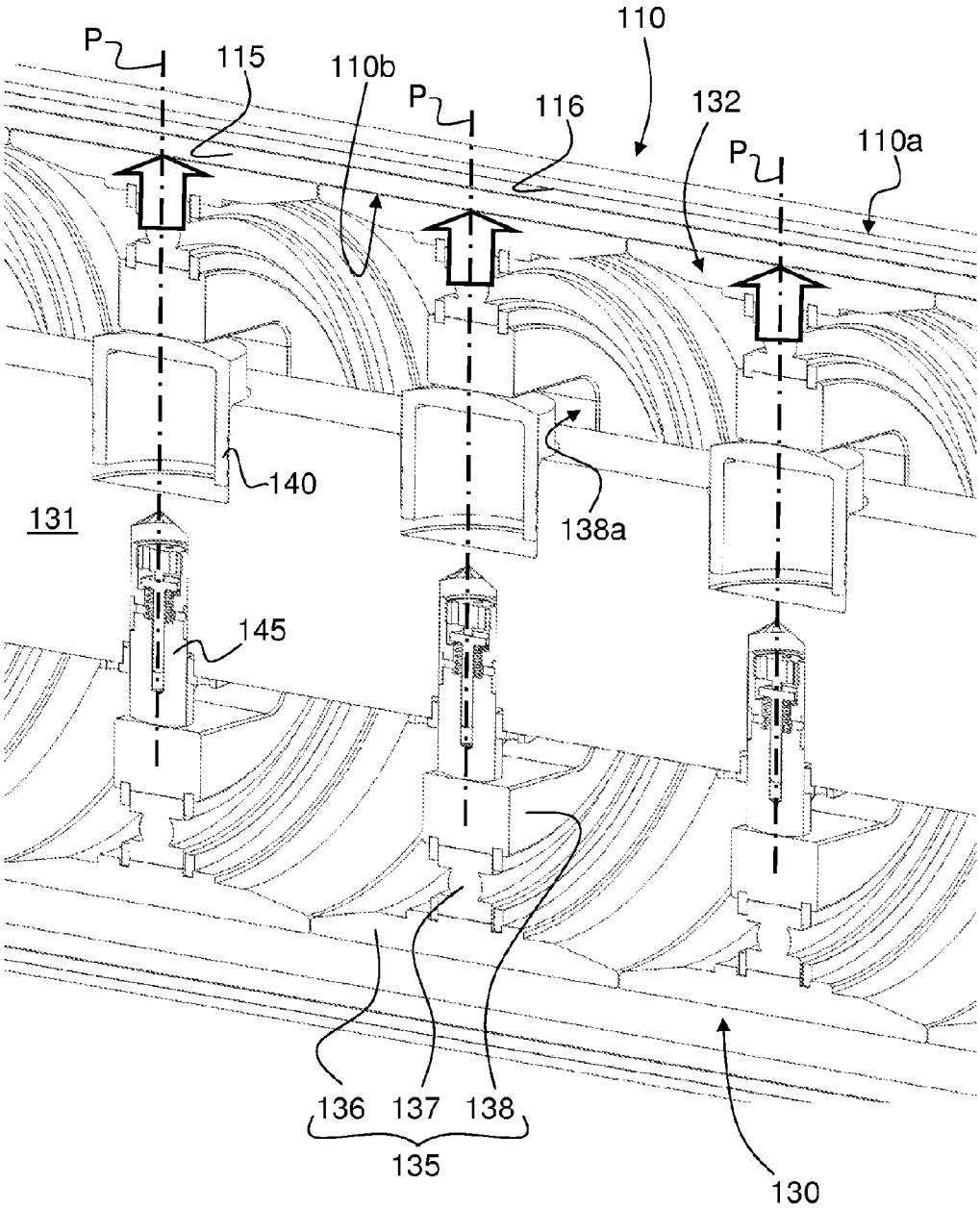
FIG. 12 is a perspective sectional view of an inner portion of the rotatable hollow cylindrical body (taken along an axis of rotation of the hollow cylindrical body) of the ink wiping system illustrating the application of pressure on an inner surface of the hollow cylindrical body via a plurality of pressing units.
Figure 13:
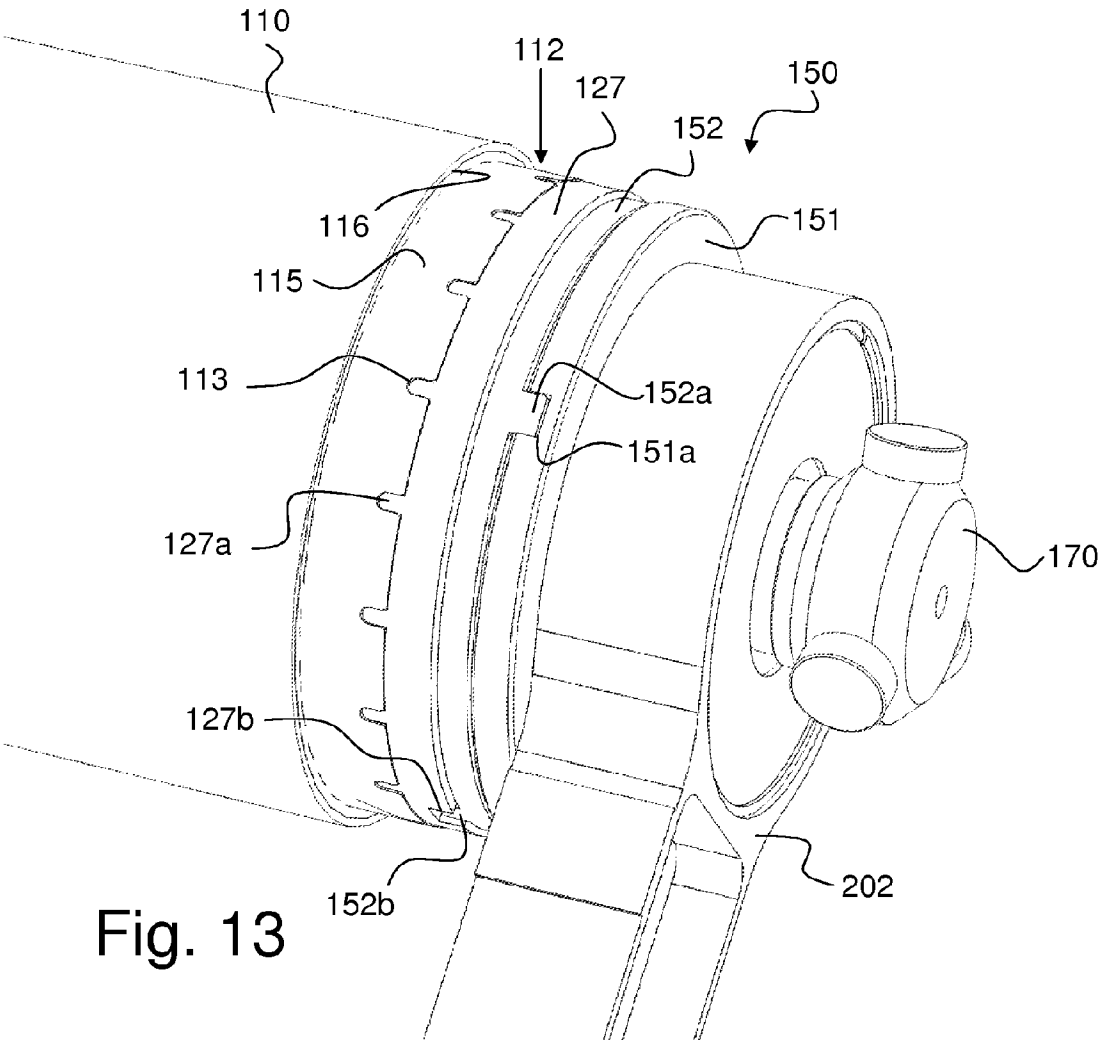
FIG. 13 is an enlarged perspective view of a driving end of the rotatable hollow cylindrical body where the rotatable hollow cylindrical body is driven into rotation.

More precisely, as schematically illustrated in FIGS. 10 to 12, each pressing unit 132 is designed in such a way that the pressing member 135 can be translated along a line, depicted in FIGS. 1 and 10 to 12 by dashed-line P, under the action of the corresponding actuator 140. In this example, line P coincides, in the working position of the wiping roller assembly 102, with a line intersecting the axis of rotation of the intaglio printing cylinder 80.

Each pressing member 135 preferably comprises a rotatable pressure ring 136 positioned for rolling contact with an inner section of the inner surface 110*b* of the hollow cylindrical body 110 and a roller bearing 137 having an outer cage secured to the inside of the rotatable pressure ring 136, the actuator being arranged inside an inner cage of the roller bearing 137 to adjust a radial position of the rotatable pressure ring 136 and of the roller bearing 137 inside the hollow cylindrical body 110.

In the illustrated example, each pressing unit 132 further comprises a guide member 138 interposed between the inner cage of the roller bearing 137 and the actuator 140 to allow radial translation of the rotatable pressure ring 136 and the roller bearing 137 under the action of the actuator 140. More precisely, as shown in FIG. 11, the guide member 138 is provided with a guiding aperture 138*a* through which the central beam 131 runs. In other words, the guide member 138 is guided onto the central beam 131 to ensure that that the position-adjustable pressing member 135 (namely the rotatable pressure ring 136, the roller bearing 137 and the guide member 138) can be translated along line P under the action of the actuator 140.

As further shown in FIG. 11, each actuator 140, which is designed in this example as a pneumatic piston, is connected to a conduit 141 running through the central beam 131 for coupling to an adequate pneumatic supply. The actuator could alternatively be actuated by hydraulic or electro-mechanical means. A pneumatic circuit with a suitable control unit (not shown) enables to individually control the pressure levels acting on each actuator 140 and therefore on each pressing unit 132.

One will thus understand that wiping pressure can be adjusted and controlled by means of each pressing unit 132 which exerts a corresponding pressure level onto a relevant section of the inner surface of the hollow cylindrical body 110 as depicted by the broad arrows in FIGS. 10 to 12. Wiping pressure can therefore be adjusted at a plurality of axial positions along the length of the hollow cylindrical body 110.

According to this preferred embodiment, shock absorbers or dampers 145 are further provided on the central beam 131, in opposite relationship with respect to corresponding actuators 140. Each shock absorber or damper 145 is interposed between the central beam 131 and a corresponding section of the guide member 138, opposite to the location where the actuator 140 acts on the guide member 138. These shock absorbers or dampers 145 are preferably provided in order to dissipate kinetic energy. This is particularly useful in the context of an intaglio printing press comprising a plate cylinder carrying one or more intaglio printing plates as the wiping system has to cope with the presence of corresponding cylinder pits that are provided in such a case on the plate cylinder. In essence, the shock absorbers or dampers are designed to prevent the wiping roller assembly 102 from "falling" into the cylinder pits of the intaglio printing cylinder 80. The shock absorbers or dampers 145 can advantageously be designed as hydraulic damping pistons. In such a case, as shown in FIG. 11, a further conduit 146 is provided in the central beam 131 in order to couple the shock absorbers or dampers 145 to a common hydraulic supply (not shown).

FIGS. 9 to 13 also illustrate the construction details of the rotatable hollow cylindrical body 110. This cylindrical body 110 is preferably formed of a cylindrical base 115, for instance made of composite material, and at least one, but preferably a plurality of layers 116 of wiping material, for instance polymer material such as PVC, provided on the outer portion of the cylindrical base 115. The rotatable hollow cylindrical body 110 of the invention is self-supporting, i.e. it does not require a full and heavy cylinder base as in the known solutions discussed in the preamble hereof, therefore leading to a lighter component that is easier to handle.

International Applications Nos. WO 2007/031925 A2, WO 2007/031927 A2 and WO 2007/034362 A2, all incorporated herein by reference, describe methods and apparatuses that could be used to apply the layers of wiping material 116 onto the cylindrical base 115.

The inner surface of the cylindrical base 115 forms the inner surface 110*b* of the hollow cylindrical body 110, while the outer surface of the upper layer of wiping material 116 forms the outer surface 110*a* of the hollow cylindrical body 110. During operation, this upper layer is in contact with the surface of the intaglio-printing cylinder 80 to wipe excess ink from the surface of the intaglio-printing cylinder 80.

The cylindrical base 115 is preferably formed and/or constructed to exhibit a high resistance to torsion. Fiber-reinforced composite materials, such as carbon fiber, are preferred materials in the context of this invention.

As already mentioned hereinabove, and schematically illustrated in FIGS. 3 and 10, the entire wiping roller assembly 102 can be pivoted along direction A thanks to the supporting mechanism 200. In other words, the supporting mechanism 200 is designed to move the wiping roller assembly 102 between a working position (as depicted in FIGS. 3 and 10), where the outer surface 110*a* of the hollow cylindrical body 110 contacts the surface of the intaglio printing cylinder 80, and a maintenance position, where the wiping roller assembly 102 is moved away from the intaglio printing cylinder 80.

FIGS. 8, 9 and 13 to 17 further illustrate the mechanical coupling between the tripod drive head 170, the Oldham coupler arrangement 150 and the hollow cylindrical body 110.

The Oldham coupler arrangement 150 comprises the input coupler 151 and an intermediate coupler 152 having substantially the shape of a ring which cooperates with the rotatable supporting ring 127 of the second cylinder bearing 125. The rotatable supporting ring 127 is designed to act as output coupler of the Oldham coupler arrangement 150. The input coupler 151 is shaped as a wheel with groove sections 151*a* for cooperation with corresponding tongue sections 152*a* provided on a first side of the intermediate coupler 152. Similarly, the rotatable supporting ring 127, acting as output coupler, is provided with groove sections 127*b* for cooperation with corresponding tongue sections 152*b* provided on a second side of the intermediate coupler 152. The tongue sections 152*a*, 152*b* are provided at right angles with respect to one another.

Rotational movement is transmitted to the hollow cylindrical body 110 by way of driving cogs 127*a* provided on the rotatable supporting ring 127, which driving cogs 127*a* cooperate with corresponding driving slots 113 provided at the second end of the hollow cylindrical body 110, namely at the corresponding end of the cylindrical base 115.

As shown in FIG. 9, a roller bearing 155 is provided on an inner side of the input coupler 151 for rotational support of the input coupler 151 onto the central beam 131. Roller bearings 156 are further provided on an outer side of the output coupler 151 for allowing a rotatable support between the input coupler 151 and the extremity of the second arm 202 of the supporting mechanism 200.

Figure 14:
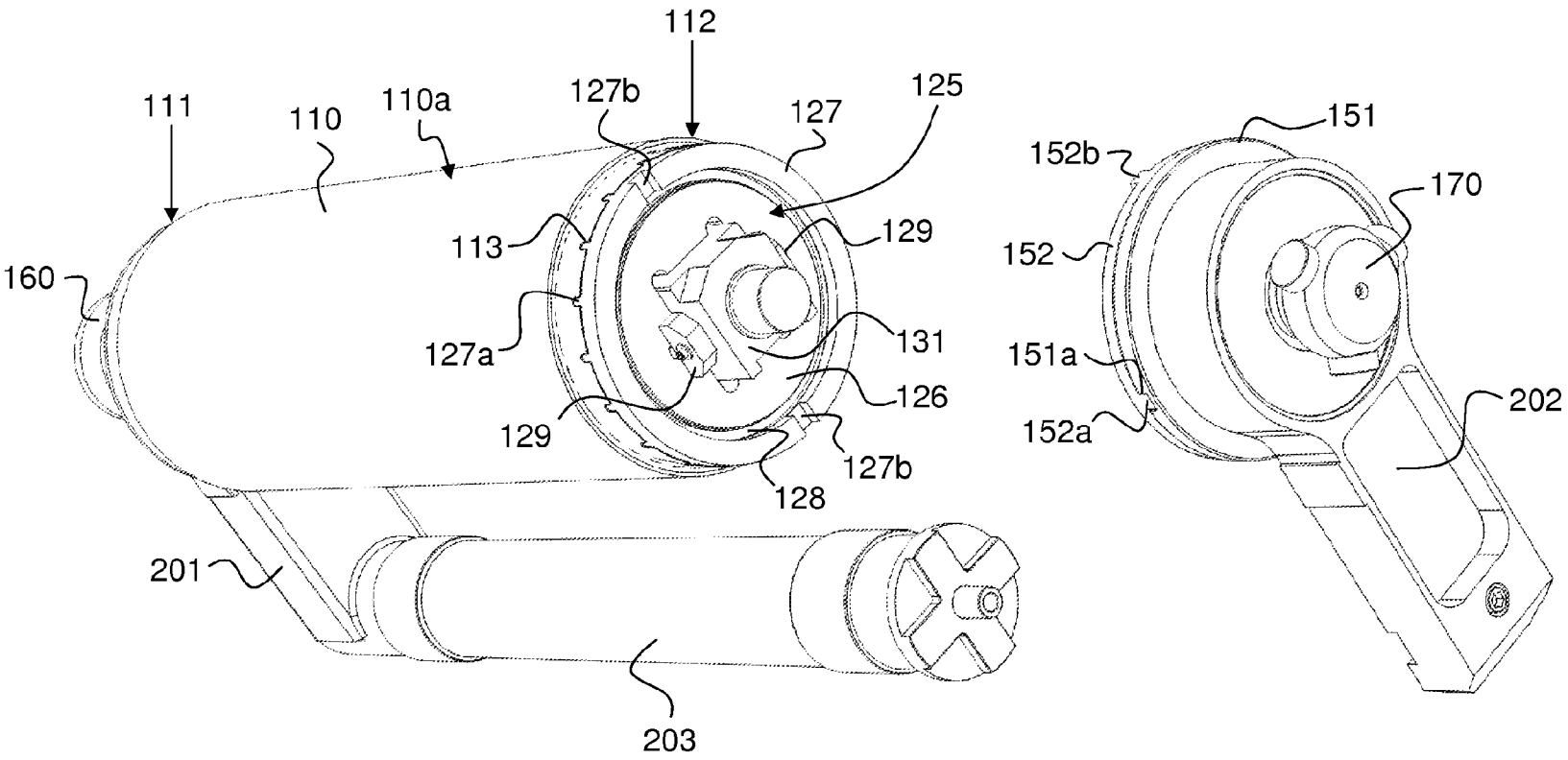
FIG. 14 is an exploded view of the ink wiping system with an arm of the supporting mechanism disassembled from the hollow cylindrical body.
Figure 15:
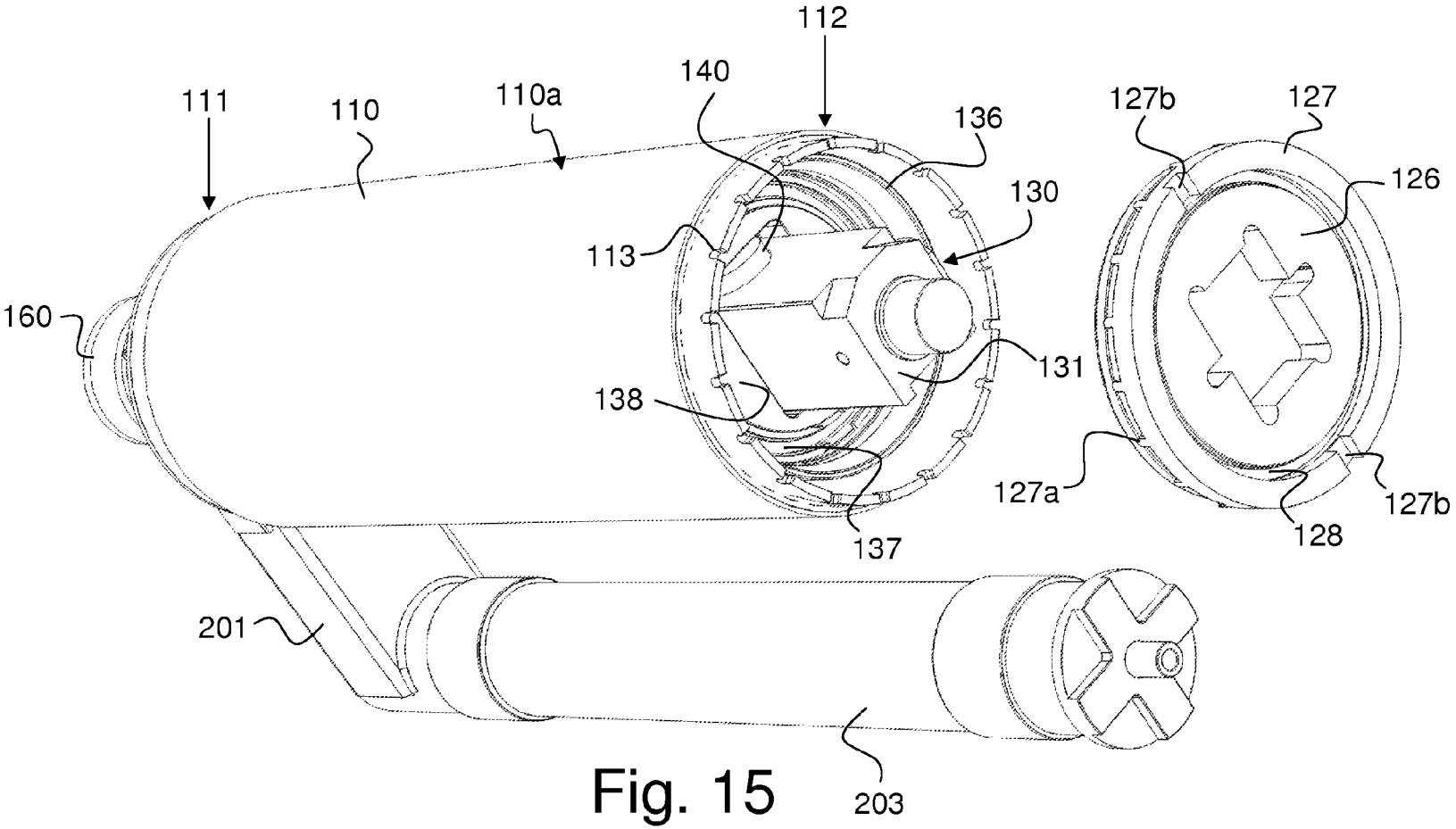
FIG. 15 is an exploded view of the ink wiping system with a coupler part disassembled from the hollow cylindrical body.
Figure 16:
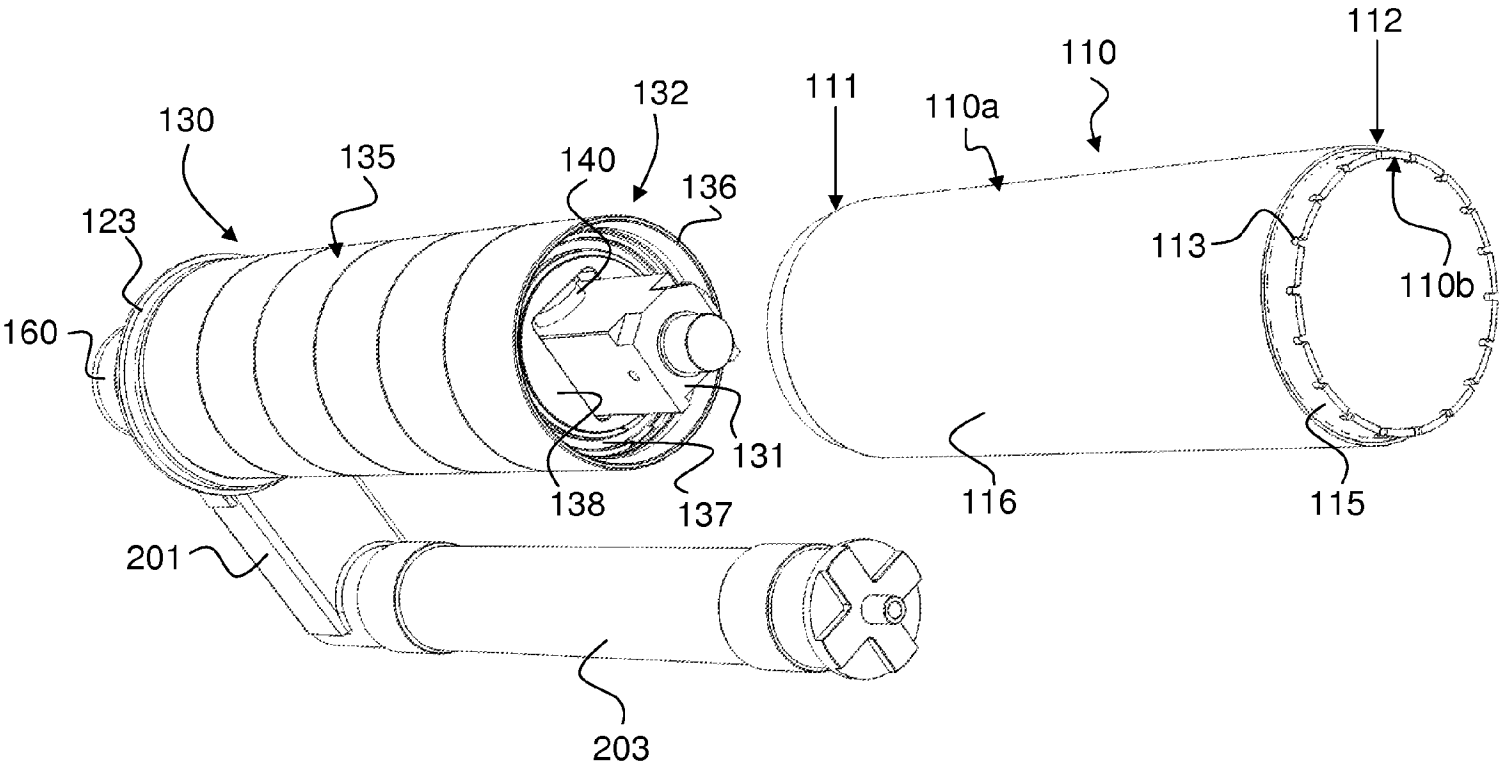
FIG. 16 is an exploded view of the ink wiping system with the hollow cylindrical body removed from the pressing device.

As illustrated by FIGS. 14 to 16, the Oldham coupler arrangement 150 can advantageously be decoupled from the wiping roller assembly 102 during maintenance operations, i.e. by decoupling the intermediate coupler 152 from the rotatable supporting ring 127. Once the lateral stops 129 holding the rotatable supporting ring 127 on the central beam 131 have been removed (see FIG. 15), the rotatable supporting ring 127 can be disassembled, together with the flange 126 and roller bearing 128 to provide access to the hollow cylindrical body 110. This hollow cylindrical body 110 can then be removed from the pressing device 130 and central beam 131 by sliding the hollow cylindrical body 110 along its axis of rotation, as depicted by FIG. 16, and replaced by a new one. All these steps can be carried out by a single operator and by hand, thanks to the light-weight construction, there being no need for a crane anymore as the hollow cylindrical body 110 weighs substantially less than a conventional wiping roller.

Various modifications and/or improvements may be made to the above-described embodiments without departing from the scope of the invention as defined by the annexed claims. For instance, the illustrated embodiment is provided with six pressing units 132. Variants involving a greater or lower number of pressing units can be envisaged.

In addition, while an Oldham coupler arrangement was discussed hereinabove, other coupler arrangements could be envisaged, such as a Cardan joint or like universal joint.

Furthermore, while this has not specifically been discussed above, pivoting of the wiping roller assembly 102 between the working position and the maintenance position can be carried by a suitable drive, such as an electric motor.

It is further to be appreciated that, while FIGS. 14 to 16 show that the second arm 202 is completely removed from the supporting mechanism 200, the supporting mechanism 200 could be designed to allow for the second arm 202 to be displaced axially away from the second end 112 of the hollow cylindrical body, while still being attached to the support beam 203, and then be pivoted out of the way of the hollow cylindrical body 110 to allow for a replacement of the hollow cylindrical body 110.

It is further to be appreciated that the above-discussed pressing device can also be used to exert pressure on a first side of a displaceable wiping medium, such as a wiping web, whose second surface, opposite the first surface, is positioned to wipe excess ink from the surface of a rotatable intaglio printing cylinder of an intaglio printing press. Use of the pressing device together with a hollow cylindrical body as discussed above is however preferred.

LIST OF REFERENCE NUMERALS USED THEREIN

1 intaglio printing press (sheet-fed)
2 sheet feeder
3 intaglio printing unit
4 sheet delivery (with three delivery pile units)
5 optical inspection system (e.g. NotaSave®)
6 drying unit
7 impression cylinder (three-segment cylinder)
8 plate cylinder (three-segment cylinder carrying three intaglio printing plates 8*a-c*)
8*a-c* intaglio printing plates
9 inking system (direct+indirect inking)
9.5 ink collecting cylinder/Orlof cylinder (two-segment cylinder)
9.10 ink duct (first inking unit)
9.11 pair of ink application rollers (first inking unit)
9.13 chablon cylinder/selective inking cylinder (first inking unit)
9.20 ink duct (second inking unit)
9.21 pair of ink application rollers (second inking unit)
9.23 chablon cylinder/selective inking cylinder (second inking unit)
9.30 ink duct (third inking unit)
9.31 pair of ink application rollers (third inking unit)
9.33 chablon cylinder/selective inking cylinder (third inking unit)
9.40 ink duct (fourth inking unit)
9.41 pair of ink application rollers (fourth inking unit)
9.43 chablon cylinder/selective inking cylinder (fourth inking unit)
9.44 additional ink roller (fourth inking unit)
10 ink wiping system
10.1 wiping tank
10.2 wiping roller
10.3 cleaning means for removing wiped ink residues from the surface of the wiping roller 10.2
10.4 drying blade for removing wiping solution residues from the surface of the wiping roller 10.2
11 sheet transporting system (endless conveying system with a pair of endless chains driving a plurality of spaced-apart gripper bars for holding a leading edge of the sheets)
12 crane (for removing wiping roller 10.2)
70 impression cylinder
80 intaglio printing cylinder
100 ink wiping system
101 wiping tank
102 wiping roller assembly
103 cleaning means for removing wiped ink residues from the surface of the wiping roller assembly 102 (see e.g. WO 2007/116353 A1)
104 drying blade
110 rotatable hollow cylindrical body
110*a* outer surface of hollow cylindrical body 110 positioned to wipe the
surface of the intaglio printing cylinder 110*b* inner surface of hollow cylindrical body 101
111 first end of hollow cylindrical body 110
112 second end of hollow cylindrical body 110 (driving end)
113 driving slots for cooperation with driving cogs 127*a* of rotatable supporting ring 127 acting as output coupler of Oldham coupler arrangement 150
115 cylindrical base made e.g. of fiber-reinforced composite material
116 layer(s) of wiping material (e.g. polymer material such as PVC)
121 (first) cylinder bearing (at the first end 111)
122 flange of cylinder bearing 121
123 rotatable supporting ring of cylinder bearing 121 which is coupled to first end 111 of hollow cylindrical body 110
124 roller bearing
125 (second) cylinder bearing (at the second end 112)
126 flange of cylinder bearing 125
127 rotatable supporting ring of cylinder bearing 125 which is coupled to second end 112 of hollow cylindrical body 110 (also acts as output coupler of Oldham coupler arrangement 150)
127*a* driving cogs for cooperation with driving slots 113
127*b* groove sections for cooperation with tongue sections 152*b* of intermediate coupler 152
128 roller bearing
129 lateral stops
130 pressing device
131 central beam
132 pressing units (six)
135 position-adjustable pressing member
136 rotatable pressure ring
137 roller bearing
138 guide member
138*a* guiding aperture
140 actuator (e.g. pneumatic piston)
141 conduit for pneumatic supply to actuator 140
145 shock absorber/damper (e.g. hydraulic damping piston)
146 conduit for hydraulic supply to shock absorber/damper
150 Oldham coupler arrangement (driving end)
151 input coupler (wheel-shaped) of Oldham coupler arrangement 150 which is driven into rotation by the wiping roller drive (not illustrated) via the tripod drive head 170
151*a* groove sections for cooperation with tongue sections 152*a* of intermediate coupler 152
152 intermediate coupler (ring-shaped) interposed between the input coupler 151 and the output coupler 127 of the Oldham coupler arrangement 150
152*a* tongue sections for cooperation with groove sections 151*a* on input coupler 151
152*b* tongue sections for cooperation with groove sections 127*b* on output coupler 127
155 roller bearing for rotational support of input coupler 151 onto central beam 131
156 roller bearings for rotational support of the extremity of second arm 202 onto input coupler 151

160 device acting as cam follower for axial reciprocation of wiping roller assembly 102

170 tripod drive head for coupling to wiping roller drive (not illustrated)—tripod drive head is secured to input disc 151 of Oldham coupler arrangement 150 for rotation therewith

200 supporting mechanism coupled to wiping roller assembly 102 for moving the wiping roller assembly 102 between a working position and a maintenance position

201 first arm of supporting mechanism 200 secured to one end of the central beam 131 proximate to the first cylinder bearing 121 which supports the first end 111 of the hollow cylindrical body 110

202 second arm of supporting mechanism 200 coupled rotatably to the second end 112 of the hollow cylindrical body 110 (can be decoupled from the second end 112 of the hollow cylindrical body 110)

203 support beam

204 supporting feet for rotational support of support beam 203

A pivotal movement to bring wiping roller assembly 102 from working position to maintenance position (and vice versa)

P direction along which pressure is applied between the wiping roller assembly 102 and the intaglio printing cylinder 80/direction of translation of actuator 140 and position-adjustable pressing member 135

The invention claimed is:

1. An ink wiping system for an intaglio printing press comprising a rotatable wiping roller assembly designed to wipe excess ink from the surface of a rotatable intaglio printing cylinder of the intaglio printing press, wherein the rotatable wiping roller assembly comprises:

a rotatable hollow cylindrical body having an outer surface positioned to wipe the surface of the intaglio printing cylinder; and a pressing device disposed inside the hollow cylindrical body and designed to exert pressure on an inner surface of the hollow cylindrical body and to allow adjustment of a wiping pressure between the hollow cylindrical body and the intaglio printing cylinder, wherein the wiping pressure between the hollow cylindrical body and the intaglio printing cylinder is adjustable by the pressing device at a plurality of axial positions along the length of the hollow cylindrical body, where the pressing device comprises a plurality of pressing units that are distributed axially along the inside of the hollow cylindrical body to allow adjustment of the wiping pressure between the hollow cylindrical body and the intaglio printing cylinder at the plurality of axial positions along the length of the hollow cylindrical body, wherein each pressing unit comprises a position-adjustable pressing member designed to exert pressure on the inner surface of the hollow cylindrical body and an actuator designed to allow adjustment of a radial position of the pressing member inside the hollow cylindrical body, and wherein the position-adjustable pressing member comprises a rotatable pressure ring positioned for rolling contact with an inner section of the inner surface of the hollow cylindrical body and a roller bearing having on outer cage secured to the inside of the rotatable pressure ring, the actuator being arranged inside an inner cage of the roller bearing to adjust a radial position of the rotatable pressure ring and of the roller bearing inside the hollow cylindrical body.

2. The ink wiping system as defined in claim 1, wherein the actuator is a pneumatic piston.

3. The ink wiping system as defined in claim 1, wherein the pressing device is disposed on a central beam extending axially through the hollow cylindrical body and wherein the hollow cylindrical body is rotatably supported on the central beam via cylinder bearings.

4. The ink wiping system as defined in claim 3, wherein at least one of the cylinder bearings is removable from the central beam to enable replacement of the hollow cylindrical body.

5. The ink wiping system as defined in claim 1, further comprising a supporting mechanism designed to move the wiping roller assembly between a working position, where the outer surface of the hollow cylindrical body contacts the surface of the intaglio printing cylinder, and a maintenance position, where the wiping roller assembly is moved away from the intaglio printing cylinder.

6. The ink wiping system as defined in claim 1, wherein the hollow cylindrical body is driven into rotation via a coupler arrangement which is coupled at an input side to a drive and at an output side to an end of the hollow cylindrical body.

7. The ink wiping system as defined in claim 1, wherein the hollow cylindrical body comprises a cylindrical base, which cylindrical base supports at least one layer of wiping material.

8. The ink wiping system as defined in claim 7, wherein the cylindrical base is made of a torsion-resistant material.

9. The ink wiping system as defined in claim 8, wherein the cylindrical base is made of fiber-reinforced composite material.

10. The ink wiping system as defined in claim 7, wherein the at least one layer of wiping material is a layer of polymer material.

11. The ink wiping system as defined in claim 10, wherein the polymer material is PVC material.

12. An ink wiping system for an intaglio printing press comprising a pressing device designed to exert pressure on a first surface of a displaceable wiping medium whose second surface, opposite the first surface, is positioned to wipe excess ink from the surface of a rotatable intaglio printing cylinder of the intaglio printing press, wherein the pressing device extends transversely to a direction of displacement of the wiping medium and is further designed to allow adjustment of a wiping pressure between the wiping medium and the intaglio printing cylinder at a plurality of transverse positions transversely to the direction of displacement of the wiping medium, wherein the ink wiping system comprises a plurality of pressing units that are distributed transversely to the direction of displacement of the wiping medium to allow adjustment of the wiping pressure between the wiping medium and the intaglio printing cylinder at the plurality of transverse positions transversely to the direction of displacement of the wiping medium, wherein each pressing unit comprises a position-adjustable pressing member designed to exert pressure on the surface of the wiping medium and an actuator designed to allow adjustment of a position of the pressing member and of the pressure exerted by the pressing member on the first surface of the wiping medium, and wherein the position-adjustable pressing member comprises a rotatable pressure ring positioned for rolling contact with a section of the surface of the wiping medium and a roller bearing having an outer cage secured to the inside of the rotatable pressure ring, the actuator being arranged inside an inner cage of the roller bearing to allow adjustment of a position of the rotatable pressure ring and of the roller bearing, thereby leading to adjustment of the pressure exerted by the rotatable pressure ring on the first surface of the wiping medium.

13. The ink wiping system as defined in claim 12, wherein the actuator is a pneumatic piston.

14. The ink wiping system as defined in claim 12, wherein the pressing device is disposed on a beam extending transversely to the direction of displacement of the wiping medium.

15. The ink wiping system as defined in claim 1, wherein each pressing unit further comprises a guide member interposed between the inner cage of the roller bearing and the actuator to allow radial translation of the rotatable pressure ring and of the roller bearing under the action of the actuator.

16. An ink wiping system for an intaglio printing press comprising a rotatable wiping roller assembly designed to wipe excess ink from the surface of a rotatable intaglio printing cylinder of the intaglio printing press, wherein the rotatable wiping roller assembly comprises:

a rotatable hollow cylindrical body having an outer surface positioned to wipe the surface of the intaglio printing cylinder; and a pressing device disposed inside the hollow cylindrical body and designed to exert pressure on an inner surface of the hollow cylindrical body and to allow adjustment of a wiping pressure between the hollow cylindrical body and the intaglio printing cylinder, wherein the wiping pressure between the hollow cylindrical body and the intaglio printing cylinder is adjustable by the pressing device at a plurality of axial positions along the length of the hollow cylindrical body, wherein the pressing device comprises a plurality of pressing units that are distributed axially along the inside of the hollow cylindrical body to allow adjustment of the wiping pressure between the hollow cylindrical body and the intaglio printing cylinder at the plurality of axial positions along the length of the hollow cylindrical body, and wherein each pressing unit further comprises a shock absorber or damper to dissipate kinetic energy.

17. The ink wiping system as defined in claim 16, wherein the shock absorber or damper is a hydraulic damping piston.

18. An intaglio printing press comprising an ink wiping system as defined in claim 1.

19. The ink wiping system as defined in claim 12, wherein each pressing unit further comprises a guide member interposed between the inner cage of the roller bearing and the actuator to allow radial translation of the rotatable pressure ring and of the roller bearing under the action of the actuator.

20. An ink wiping system for an intaglio printing press comprising a pressing device designed to exert pressure on a first surface of a displaceable wiping medium whose second surface, opposite the first surface, is positioned to wipe excess ink from the surface of a rotatable intaglio printing cylinder of the intaglio printing press, wherein the pressing device extends transversely to a direction of displacement of the wiping medium and is further designed to allow adjustment of a wiping pressure between the wiping medium and the intaglio printing cylinder at a plurality of transverse positions transversely to the direction of displacement of the wiping medium, wherein the ink wiping system comprises a plurality of pressing units that are distributed transversely to the direction of displacement of the wiping medium to allow adjustment of the wiping pressure between the wiping medium and the intaglio printing cylinder at the plurality of transverse positions transversely to the direction of displacement of the wiping medium, and wherein each pressing unit further comprises a shock absorber or damper to dissipate kinetic energy.

21. The ink wiping system as defined in claim 20, wherein the shock absorber or damper is a hydraulic damping piston.

22. An intaglio printing press comprising an ink wiping system as defined in claim 12.

23. An intaglio printing press comprising an ink wiping system as defined in claim 16.

24. An intaglio printing press comprising an ink wiping system as defined in claim 20.

* * * * *